US009556758B2

(12) United States Patent
Mukaide et al.

(10) Patent No.: US 9,556,758 B2
(45) Date of Patent: Jan. 31, 2017

(54) CONTROL VALVE

(71) Applicant: AISIN SEIKI KABUSHIKI KAISHA, Kariya-shi (JP)

(72) Inventors: Hiroki Mukaide, Chiryu (JP); Shigemitsu Suzuki, Takahama (JP); Naoto Toma, Kariya (JP)

(73) Assignee: AISIN SEIKI KABUSHIKI KAISHA, Kariya-shi, Aichi-ken (JP)

( * ) Notice: Subject to any disclaimer, the term of this patent is extended or adjusted under 35 U.S.C. 154(b) by 161 days.

(21) Appl. No.: 14/470,093

(22) Filed: Aug. 27, 2014

(65) Prior Publication Data

US 2015/0059671 A1 Mar. 5, 2015

(30) Foreign Application Priority Data

Aug. 27, 2013 (JP) ..... 2013-175892

(51) Int. Cl.
*F01L 1/34* (2006.01)
*F01L 1/344* (2006.01)

(52) U.S. Cl.
CPC ..... *F01L 1/3442* (2013.01); *F01L 2001/3443* (2013.01); *F01L 2001/34423* (2013.01); *F01L 2001/34426* (2013.01); *F01L 2001/34453* (2013.01); *F01L 2001/34459* (2013.01)

(58) Field of Classification Search
CPC ..... F01L 2001/34426; F01L 1/3442; F01L 2001/34423; F01L 2001/3443; F01L 2001/34453; F01L 2001/34459
USPC ..... 123/90.12, 90.15, 90.17
See application file for complete search history.

(56) References Cited

U.S. PATENT DOCUMENTS

2003/0010303 A1* 1/2003 Kanada ..... F01L 1/022 123/90.17
2003/0121486 A1* 7/2003 Komazawa ..... F01L 1/3442 123/90.17
2009/0025668 A1 1/2009 Matsusaka et al.
2009/0178635 A1* 7/2009 Takenaka ..... F01L 1/3442 123/90.17

(Continued)

FOREIGN PATENT DOCUMENTS

JP 2011-001852 A 1/2011
JP 2013-019282 A 1/2013
WO 2006-043716 A1 4/2006

OTHER PUBLICATIONS

The extended European Search Report issued on Jan. 30, 2015, by the European Patent Office in corresponding European Application No. 14182034.0-1603. (4 pages).

*Primary Examiner* — Ching Chang
(74) *Attorney, Agent, or Firm* — Buchanan Ingersoll & Rooney PC

(57) ABSTRACT

A control valve includes a valve case, a spool accommodated in the valve case, an electromagnetic solenoid operating the spool along a spool axis extending in a longitudinal direction, the valve case including a pump port, an advanced angle port, a retarded angle port, and an unlocking port, the spool being operated to at least five positions, and a lock control fluid passage formed inside the spool in an attitude along the spool axis, the lock control fluid passage allowing the fluid from the pump port to be supplied only to the unlocking port irrespective of the position of the spool when the spool is operated to any one of the positions at which the fluid is supplied from the pump port to the unlocking port.

7 Claims, 20 Drawing Sheets

(56) References Cited

U.S. PATENT DOCUMENTS

| | | | | |
|---|---|---|---|---|
| 2010/0288215 | A1* | 11/2010 | Takemura | F01L 1/3442<br>123/90.15 |
| 2012/0073531 | A1* | 3/2012 | Urushihata | F01L 1/3442<br>123/90.15 |
| 2013/0133599 | A1* | 5/2013 | Ikuma | F01L 1/34<br>123/90.17 |

* cited by examiner

| | PA2 | PA1 | PL | PB1 | PB2 |
|---|---|---|---|---|---|
| Advanced angle chamber | Oil supplied | Oil supplied | Oil blocked | Oil drained | Oil drained |
| Retarded angle chamber | Oil drained | Oil drained | Oil blocked | Oil supplied | Oil supplied |
| Lock member | Oil drained | Oil supplied | Oil supplied | Oil supplied | Oil drained |

CONTROL VALVE

CROSS REFERENCE TO RELATED APPLICATIONS

This application is based on and claims priority under 35 U.S.C. §119 to Japanese Patent Application 2013-175892, filed on Aug. 27, 2013, the entire content of which is incorporated herein by reference.

TECHNICAL FIELD

This disclosure generally relates to a control valve.

BACKGROUND DISCUSSION

A known control valve disclosed in JP2011-1852A (hereinafter referred to as Patent reference 1) includes a phase control valve (referred to as an oil control valve for relative rotation in Patent reference 1) that sets a relative rotational phase by selectively supplying fluid to one of an advanced angle chamber and a retarded angle chamber, and a unlocking valve (referred to as a control valve for restriction in Patent reference 1) for releasing a restricted state by supplying a fluid to a restriction member.

According to the disclosure in Patent reference 1, a spool that structures a relative rotation control valve and a spool that structures a lock control valve are housed in a single valve body, and a part of the valve body is relatively rotatably fitted to a driven side rotation member of a variable valve timing control device.

JP2013-19282A (hereinafter referred to as Patent reference 2) discloses a control valve that houses a spool (referred to as a spool valve body in Patent reference 2) to be slidable within a valve body. The control valve disclosed in Patent reference 2 is configured to be operated to six positions, and a relative rotational phase of a variable valve timing control device (referred to as a valve timing control device) is displaced either in an advanced angle direction or a retarded angle direction by selecting one of the mentioned six positions. Further, the control valve disclosed in Patent reference 2 is configured to control a lock mechanism.

As disclosed in Patent reference 1, according to the construction that includes the phase control valve and the unlocking valve, the number of parts is large because two spools are required, which increases the device in size and costs.

According to the construction disclosed in Patent reference 2, the number of parts can be reduced because the control for the relative rotational phase and the control for the lock mechanism of the variable valve timing control device are performed using the single spool. However, because of that structure in which the single spool controls the relative rotational phase and the lock mechanism of the variable valve timing control device, numbers of land portions need to be provided on an outer surface of the spool and numbers of ports need to be provided at a valve body that houses the spool. According to the construction disclosed in Patent reference 2, the dimension in an axial direction of the spool is increased, the dimension of the valve body that houses the spool increases, and thus increasing the control valve in size.

A need thus exists for a control valve which is not susceptible to the drawback mentioned above.

SUMMARY

In light of the foregoing, the disclosure provides a control valve for selectively supplying a fluid to one of an advanced angle chamber and a retarded angle chamber formed between a driving side rotation member synchronously rotating with a crankshaft of an internal combustion engine and a driven side rotation member integrally rotating with a camshaft of the internal combustion engine, the driven side rotation member relatively rotating to the driving side rotation member, the control valve for supplying a fluid for unlocking a lock member checking a relative rotation of the driving side rotation member and the driven side rotation member. The control valve includes a valve case, a spool accommodated in the valve case, an electromagnetic solenoid operating the spool along a spool axis extending in a longitudinal direction, the valve case including a pump port to which a fluid is supplied, an advanced angle port configured to be in communication with the advanced angle chamber, a retarded angle port configured to be in communication with the retarded angle chamber, and an unlocking port configured to be in communication with the lock member, the spool being operated to at least five positions including a first advanced angle position where the fluid is supplied to the advanced angle port and the unlocking port, a second advanced angle position where the fluid is supplied only to the advanced angle port, an unlock position where the fluid is supplied only to the unlocking port, a first retarded angle position where the fluid is supplied to the retarded angle port and the unlocking port, and a second retarded angle position where the fluid is supplied only to the retarded angle port, and a lock control fluid passage formed inside the spool in an attitude along the spool axis, the lock control fluid passage allowing the fluid from the pump port to be supplied only to the unlocking port irrespective of the position of the spool when the spool is operated to any one of the positions at which the fluid is supplied from the pump port to the unlocking port.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Embodiments of the control valve will be explained with reference to illustrations of drawing figures as follows.

Figure 1:
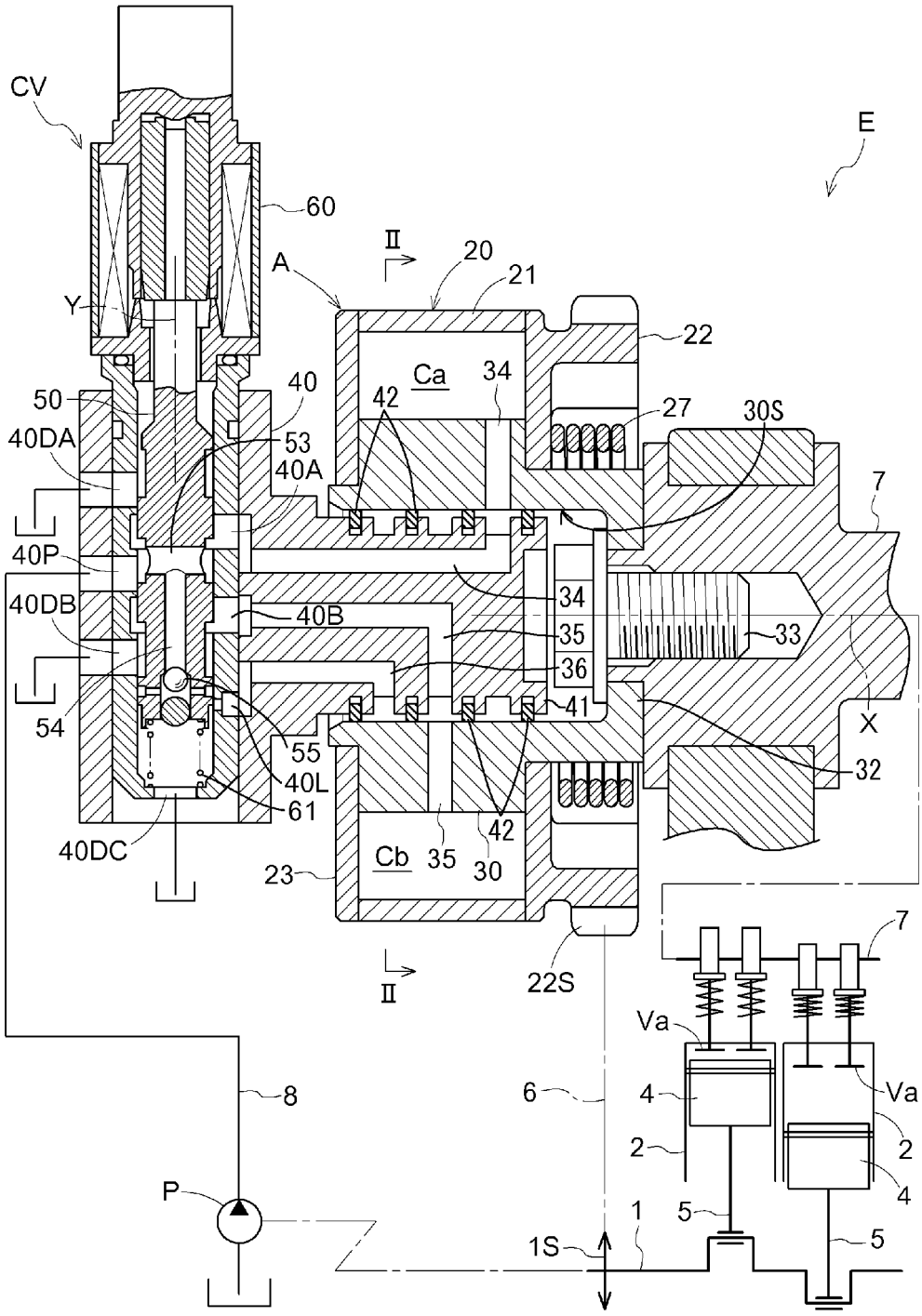
FIG. 1 is a cross sectional view of a variable valve timing control device and a control valve according to a first embodiment disclosed here.
Figure 2:
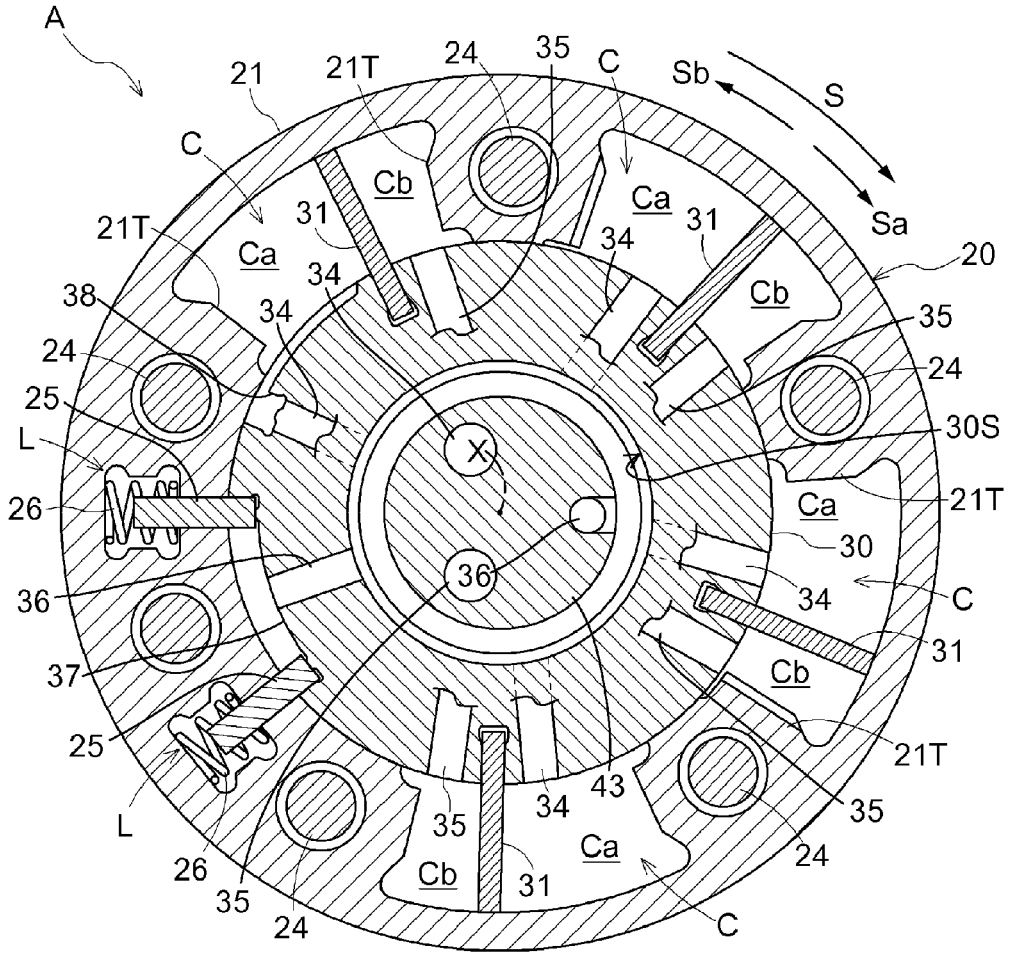
FIG. 2 is a cross-sectional view of the variable valve timing control device taken on line II-II in FIG. 1 according to embodiments disclosed here.
Figure 3:
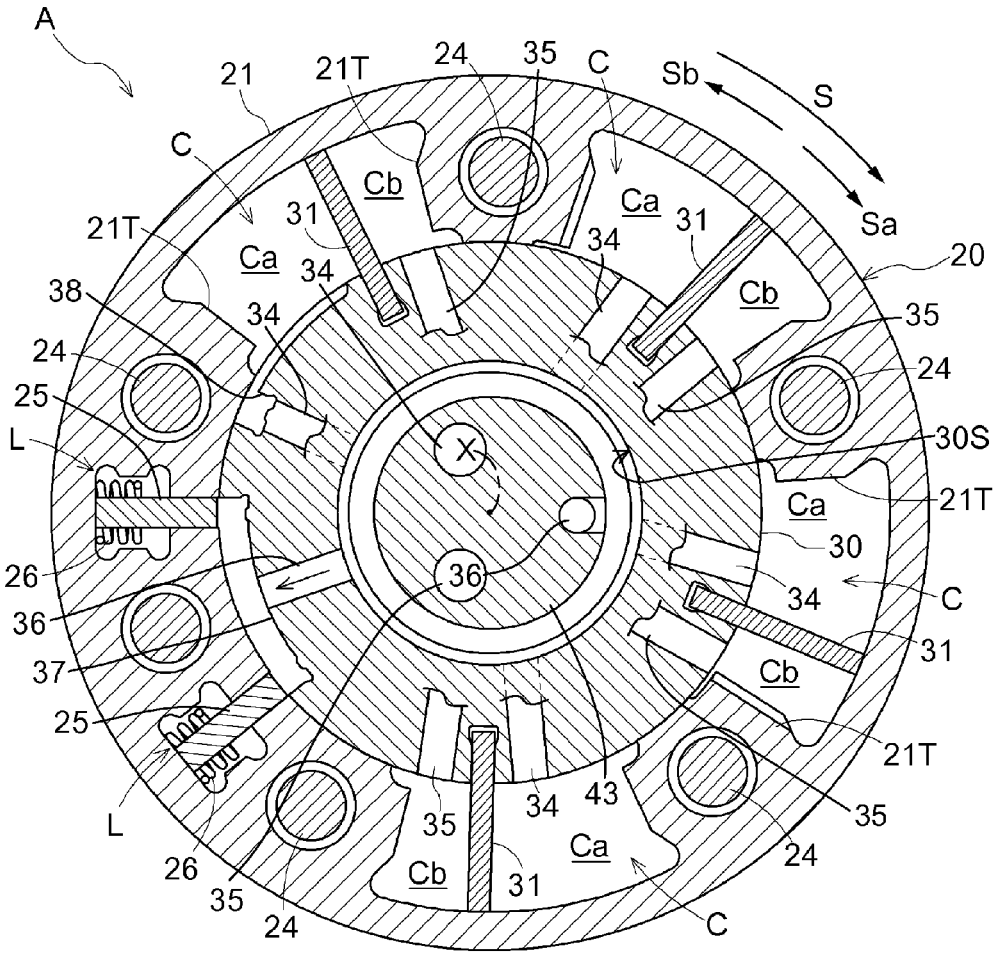
FIG. 3 is a cross-sectional view of the variable valve timing control device in an unlocked state according to the embodiments disclosed here.

Basic structure will be explained hereinafter. As illustrated in FIGS. 1 and 2, a variable valve timing control device A for setting an open and close time (opening and closing timing) of an intake valve Va is provided to an engine E as an internal combustion engine. The operation fluid (operation oil) is supplied to and exhausted from the variable valve timing control device A by a control valve CV which is electromagnetically operated. The opening and closing timing of the intake valve Va is set on the basis of the supply and exhaust of the operation oil.

The engine E (example of the internal combustion engine) is applied to a vehicle, for example, an automobile. In the engine E, a piston 4 is housed within a cylinder bore formed on a cylinder block 2, and the piston 4 and a crankshaft 1 are connected by a connecting rod 5. The engine E is a four-cycle type engine.

The variable valve timing control device A includes an outer rotor 20 (a driving side rotation member) synchronously rotating with the crankshaft 1 of the engine E, and an inner rotor 30 (driven side rotation member) integrally rotating with an intake camshaft 7 for controlling the intake valve Va of the engine E. An advanced angle chamber Ca and a retarded angle chamber Cb are formed between the outer rotor 20 (driving side rotation member) and the inner rotor 30 (driven side rotation member). The variable valve timing control device further includes a lock mechanism L for locking (fixing) a relative rotational phase of the outer rotor 20 and the inner rotor 30 at a predetermined phase.

The engine E is provided with an oil pump P driven by a driving force of the crankshaft 1. The oil pump P supplies the lubrication oil reserved in an oil pan of the engine E as operation oil (fluid) to the control valve CV. The control valve CV is supported by the engine E in a manner that a shaft portion 41 integrally formed with a valve case 40 is inserted to be positioned in the inner rotor 30. The control valve CV is configured to supply and exhaust the operation oil to and from the variable valve timing control device via fluid passages formed inside the shaft portion 41.

Thus, the control valve CV changes the relative rotational phase of the outer rotor 20 and the inner rotor 30 (hereinafter referred to as the relative rotational phase) by supplying the operation oil to the selected one of the advanced angle chamber Ca and the retarded angle chamber Cb to set the opening and closing timing of the intake valve Va. Further, the control valve CV unlocks the lock mechanism L by supplying the operation oil to the lock mechanism L.

The supported position of the control valve CV is not limited to the position shown in FIG. 1. According to an alternative construction, the control valve CV may be supported by a member which is separated, or positioned away from the variable valve timing control device A. In those circumstances, a fluid passage may be provided between the control valve CV and the variable valve timing control device A.

According to the embodiment, the variable valve timing control device A is provided at the intake camshaft 7, however, the construction is not limited. Alternatively, the variable valve timing control device A may be provided at an exhaust camshaft. Further, alternatively, the variable valve timing control device A may be provided at both of the intake camshaft 7 and the exhaust camshaft.

Constructions of the variable valve timing control device A will be explained with reference to FIGS. 1 to 4. As illustrated in FIGS. 1 to 4, in the variable valve timing control device A, the outer rotor 20 encloses the inner rotor 30, and the outer rotor 20 and the inner rotor 30 are coaxially positioned to a rotational axis X of the intake camshaft 7 to be relatively rotatable to each other. A timing chain 6 is wound around a driving sprocket 22S formed on the outer rotor 20 and around a sprocket 1S driven by the crankshaft 1. Further, the inner rotor 30 is connected to the intake camshaft 7 by means of a connection bolt 33.

The outer rotor 20 includes a rotor member 21 formed in a cylindrical shape, a rear block 22 positioned in contact with a first end of the rotor member 21 in a direction along the rotational axis X, and a front plate 23 positioned in contact with a second end of the rotor member 21 in the direction along the rotational axis X. The rear block 22 and the front plate 23 are fastened by plural fastening bolts 24. The driving sprocket 22S to which a rotational force is transmitted from the crankshaft 1 is formed at an outer periphery of the rear block 22. Plural protrusion portions 21T which protrude towards the rotational axis X (protrude radially inward) and a cylindrical inner wall surface are integrally formed at the rotor member 21.

A pair of guide grooves is formed on one of the protrusion portions 21T in a manner radially extending from the rotational axis X. A lock member 25 formed in a plate shape is provided in each of the guide grooves to be selectively protruded and retracted. A lock spring 26 for biasing the lock member 25 towards the rotational axis X is provided inside the guide groove. The lock mechanism L is structured with lock members 25 serving as a pair and the lock springs 26 that bias the lock members 25 in a protruding direction, respectively. The configuration of the lock member 25 is not limited to the plate shape. Alternatively, the lock member 25 may be formed in a rod shape, for example.

The inner rotor 30 is formed with an inner peripheral surface 30S which is formed in a cylindrical inner surface and arranged coaxially to the rotational axis X. The inner rotor 30 is further formed with an outer periphery surface about the rotational axis X. A flange portion 32 is formed at a first end of the inner rotor 30 in a direction along the rotational axis X. The inner rotor 30 is connected to the intake camshaft 7 by means of the connection bolt 33 which is inserted to and positioned in a bore portion provided at an inner peripheral position of the flange portion 32.

Further, plural vanes 31 that protrude radially outward are provided at an outer circumferential surface of the inner rotor 30. By fitting the inner rotor 30 in the outer rotor 20 (by enclosing the inner rotor 30 by the outer rotor 20), a fluid pressure chamber C is formed at a region defined by an inner surface of the rotor member 21 (cylindrical inner wall surface and the plural protrusion portions 21T) and the outer circumferential surface of the inner rotor 30. Further, the fluid pressure chamber C is divided by the vane 31 to form the advanced angle chamber Ca and the retarded angle chamber Cb. The inner rotor 30 is formed with an advanced angle fluid passage 34 which is in communication with the advanced angle chamber Ca, a retarded angle fluid passage 35 which is in communication with the retarded angle chamber Cb, and an unlocking fluid passage 36.

An intermediate lock recessed portion 37 is formed as a groove on an outer circumference of the inner rotor 30. The lock members 25 of the lock mechanism L serving as a pair is engageable with and disengageable from (selectively engaged with) the intermediate lock recessed portion 37. A most retarded angle lock recessed portion 38 is formed on the outer circumference of the inner rotor 30. One of the lock members 25 is engaged with the most retarded angle lock recessed portion 38 when the relative rotational phase is in a most retarded angle lock phase where the relative rotational phase is displaced in a retarded angle direction Sb from an intermediate lock phase at which the lock members 25 serving as a pair simultaneously engage with the intermediate lock recessed portion 37. The unlocking fluid passage 36 is in communication with the intermediate lock recessed portion 37. The advanced angle fluid passage 34 is in communication with the most retarded angle lock recessed portion 38.

In the intermediate lock phase, the lock members 25 are in contact with opposite inner walls of the intermediate lock recessed portion 37 in a circumferential direction, respectively. By supplying the operation oil to the unlocking fluid passage 36 in the intermediate lock phase, the lock members 25 are disengaged against the biasing force of the lock springs, respectively (locked state is released).

The relative rotational phase where the vane 31 reaches a moving end in the advanced angle direction Sa (rotation limit about the rotational axis X) is defined as a most advanced angle phase. The relative rotational phase where the vane 31 reaches a moving end in the retarded angle direction Sb (rotation limit about the rotational axis X) is defined as a most retarded angle phase.

In those circumstances, the intermediate lock phase is defined as any phase which is included in an intermediate region excluding the most advanced angle phase and the most retarded angle phase. The most retarded angle lock phase is not limited to the relative rotational phase of the operation limit at the most retarded angle side; rather, the most retarded angle lock phase includes the relative rotational phase of the operation limit at the most retarded angle side and a phase in the vicinity of the most retarded angle, or in the vicinity of the operation limit at the most retarded angle.

Upon the supply of the operation oil to the advanced angle fluid passage 34 at the most retarded angle lock phase, the operation oil is supplied to the most retarded angle lock recessed portion 38, and the lock member 25 is disengaged from the most retarded angle lock recessed portion 38 against the biasing force of the lock spring 26, and the relative rotational phase is displaced in the advanced angle direction Sa.

A torsion spring 27 is provided to extend at the rear block 22 of the outer rotor 20 and the inner rotor 30. The torsion spring 27 exerts the biasing force for displacing the relative rotational phase from the most retarded angle lock phase to a phase in the vicinity of the intermediate lock phase.

According to the variable valve timing control device A, the outer rotor 20 rotates in a driving rotation direction S by the driving force transmitted from the timing chain 6. By supplying the operation oil to the advanced angle chamber Ca, the relative rotational phase is displaced in the advanced angle direction Sa. By supplying the operation oil to the retarded angle chamber Cb, the relative rotational phase is displaced in the retarded angle direction Sb.

The direction in which the inner rotor 30 rotates in the same direction to a drive rotation direction S relative to the outer rotor 20 is defined as the advanced angle direction Sa, and the reversal rotation direction from the advanced angle direction Sa is defined as the retarded angle direction Sb. According to the variable valve timing control device A, the timing of air intake is advanced as the relative rotational phase displaces in the advanced angle direction Sa, and the timing of the air intake is delayed as the relative rotational phase is displaced in the retarded angle direction Sb (the closer to the most advanced angle phase, the faster the intake timing is; the closer to the most retarded angle phase, the slower the intake timing is).

The construction of the control valve CV according to the first embodiment will be explained with reference to FIGS. 1 to 6 as follows. As illustrated in FIGS. 1 to 6, the control valve CV includes the valve case 40, a spool 50, an electromagnetic solenoid 60, and a spool spring 61. The spool 50 is housed in a spool accommodation space of the valve case 40 to be movable along a spool axis Y. The electromagnetic solenoid 60 exerts the electromagnetic force in a direction against the biasing force of the spool spring 61. According to the first embodiment, the control valve CV is positioned at an upper portion of the valve case 40.

The valve case 40 is supported to the engine E via, for example, a bracket in a state where the shaft portion 41 formed at the valve case 40 is inserted and positioned inside the inner rotor 30. As described above, the shaft portion 41 is formed in a cylindrical shape coaxially to the rotation axis X, and the plural fluid passages for supplying and exhausting the fluid (operation oil) are formed in the shaft portion. Further, in order to supply and exhaust the operation oil when the variable valve timing control device A rotates about the rotation axis X, plural ring shaped seals 42 are provided between an outer periphery of the shaft portion 41 and the inner peripheral surface 30S of the inner rotor 30.

The valve case 40 is formed with a pump port 40P, an advanced angle port 40A, a retarded angle port 40B, an unlocking port 40L, a first drain port 40DA, a second drain port 40DB, and a third drain port 40DC. According to the first embodiment, the first drain port 40DA is arranged at the position closest to the electromagnetic solenoid 60 in a direction along the spool axis Y among the ports. Next to the first drain port 40DA, the advanced angle port 40A, the pump port 40P, the retarded angle port 40B, the second drain port 40DB, the unlocking port 40L, and the third drain port 40DC are positioned in a manner being away from the electromagnetic solenoid 60 in the mentioned order. The third drain port 40DC is positioned at a lower end portion of the valve case 40.

According to the construction of the first embodiment, the advanced angle port 40A is positioned at an upper portion and the retarded angle port 40B is positioned at a lower level than the advanced angle port 40A. However, the construction is not limited. Alternatively, the retarded angle port 40B may be positioned at an upper portion and the advanced angle port 40A may be positioned at a level lower than the retarded angle port 40B without changing the structure of the control valve CV.

The pump port 40P is in communication with the oil pump P via a supply fluid passage 8. The advanced angle port 40A is in communication with the advanced angle chamber Ca via the advanced angle fluid passage 34. The retarded angle port 40B is in communication with the retarded angle chamber Cb via the retarded angle fluid passage 35. The unlocking port 40L is in communication with the lock member 25 via the unlocking passage 36.

The spool 50 is formed with a pump side groove portion 51P with a smaller diameter at a center position in the direction of the spool axis Y. A first groove portion 51A for drain having a smaller diameter is formed on the spool 50 at a position higher than the pump side groove portion 51P (closer to the solenoid valve 60). A second groove portion 51B for drain having a smaller diameter is formed on the spool 50 at a position lower than the pump side groove portion 51P.

A first land portion 52A is formed on the spool 50 at an upper portion relative to the pump side groove portion 51P. A second land portion 52B is formed on the spool 50 at a lower portion relative to the pump side groove portion 51P. A third land portion 52C is formed on the spool 50 at a lower portion relative to the second groove portion 51B. An outer diameter of the first land portion 52A, the second land portion 52B, and the third land portion 52C is set at a value approximate to an inner diameter of spool accommodation space of the valve case 40.

A single phase control fluid passage 53 is formed at a portion of the pump side groove portion 51P in a manner, or attitude being orthogonal to the spool axis Y. A lock control fluid passage 54 that diverges from an intermediate position of the phase control fluid passage 53 in a direction along the spool axis Y is formed inside the spool 50. The phase control fluid passage 53 allows the supply of the operation oil to the advanced angle port 40A and the retarded angle port 40B. Further, the lock control fluid passage 54 allows the supply of the operation oil to the unlocking port 40L. A check valve 55 for maintaining unlocked state (i.e., serving as a check valve) which includes a ball, is provided at a downstream side in the lock control fluid passage 54 in a supply direction of the operation oil.

A lock operation fluid passage 56 is formed in the spool 50 to be in communication with an outer peripheral portion of the third land portion 52C and in a manner being orthogonal to the spool axis Y. A portion of the lock control fluid passage 54 that is positioned at downstream of the check valve 55 for maintaining unlocked state is in communication with the lock operation fluid passage 56.

Operations of the control valve CV will be explained hereinafter. The control valve CV of the first embodiment is configured to operate the spool 50 to predetermined desired positions against the biasing force of the spool spring 61 in accordance with the setting of the electric power supplied to the electromagnetic solenoid 60. Particularly, as illustrated in FIGS. 6 to 10, the spool 50 is operated to be positioned at a second advanced angle position PA2, a first advanced angle position PA1, an unlock position PL, a first retarded angle position PB1, and a second retarded angle position PB2 as operation positions.

Figures 4, 5:
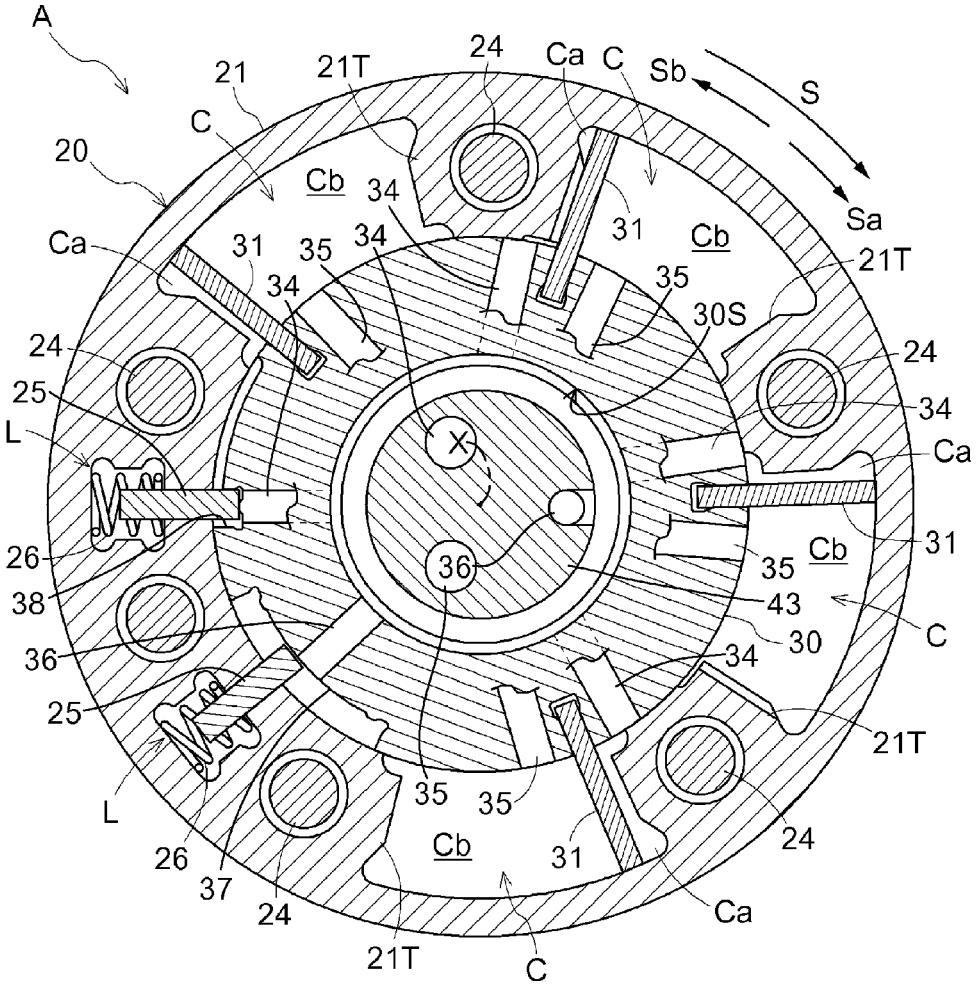
FIG. 4 is a cross-sectional view of the variable valve timing control device in a most retarded angle phase according the embodiments disclosed here.
FIG. 5 is a table showing relationships of positions of the control valve and supply or exhaust state of operation oil according to the embodiments disclosed here.

An overview of the supply and exhaust of the operation oil when the spool 50 is positioned at the second advanced angle position PA2, the first advanced angle position PA1, the unlock position PL, the first retarded angle position PB1, and the second retarded angle position PB2 is shown in FIG. 5. The relationship of the control position of the spool 50 and the supply or exhaust of the operation oil shown in FIG. 5 is common to second and third embodiments.

Figure 6:
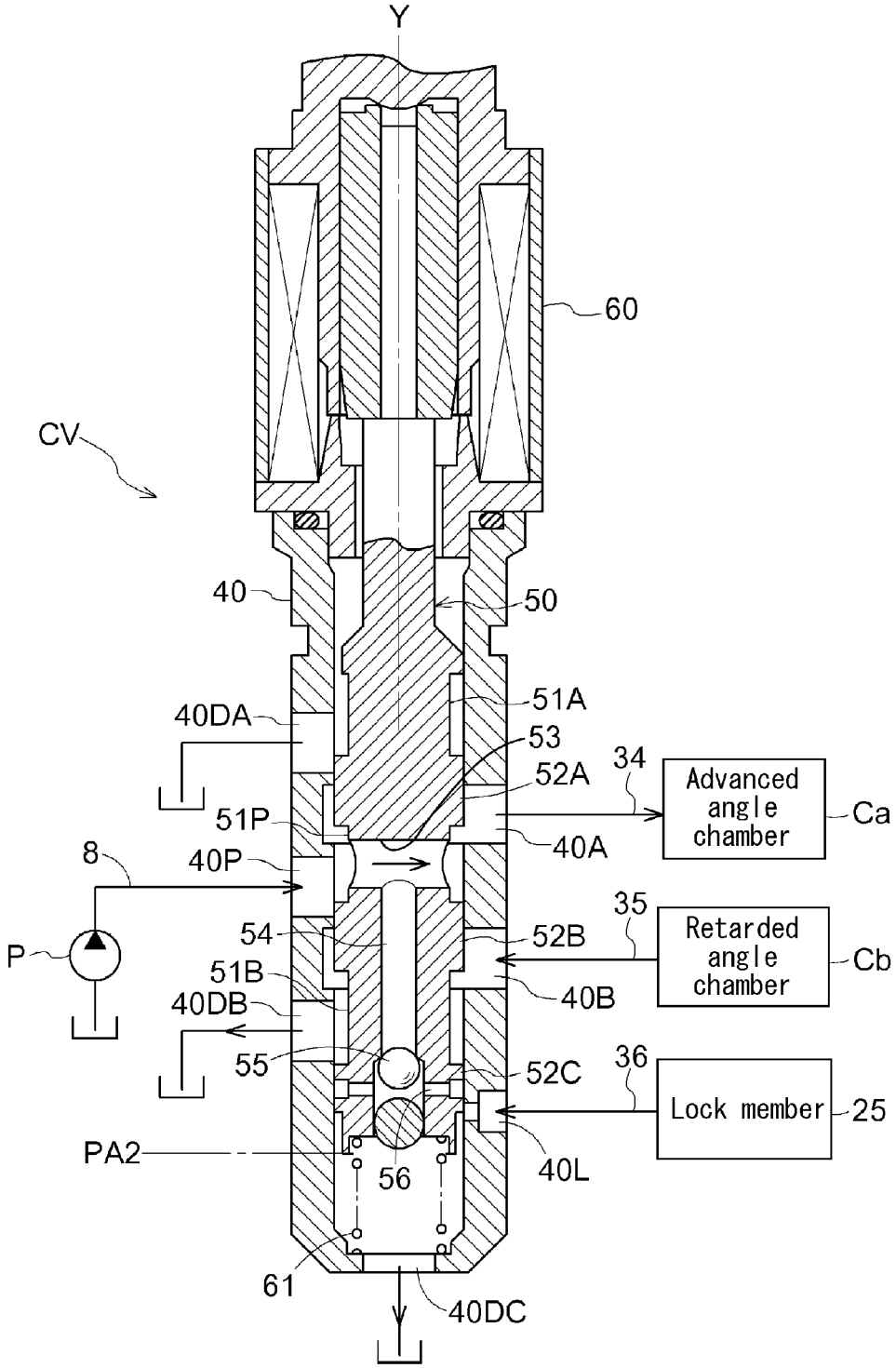
FIG. 6 is a cross-sectional view of the control valve in a second advanced angle position according to the first embodiment disclosed here.
Figure 7:
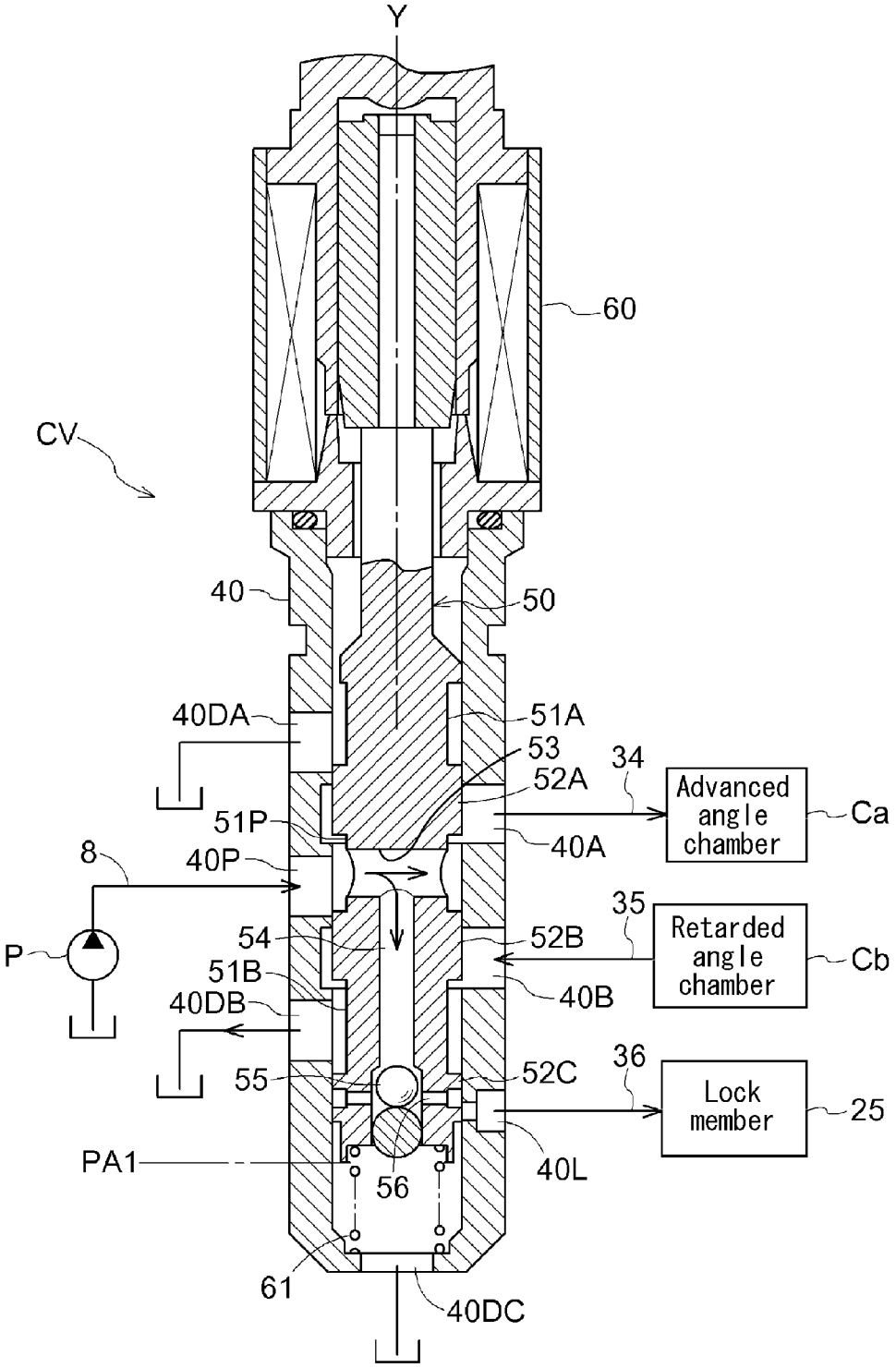
FIG. 7 is a cross-sectional view of the control valve in a first advanced angle position according to the first embodiment disclosed here.
Figure 8:
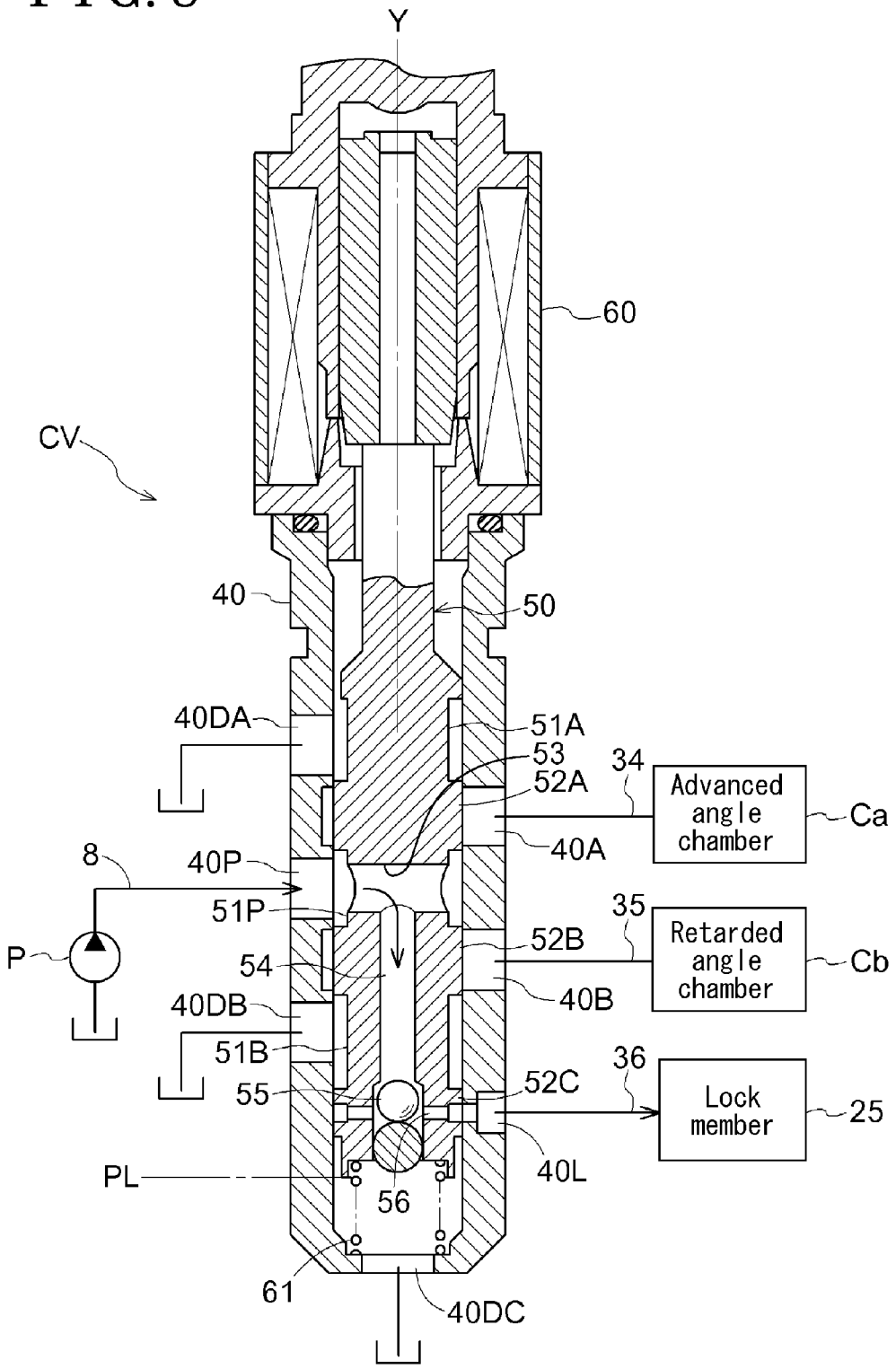
FIG. 8 is a cross-sectional view of the control valve in an unlocked position according to the first embodiment disclosed here.
Figure 9:
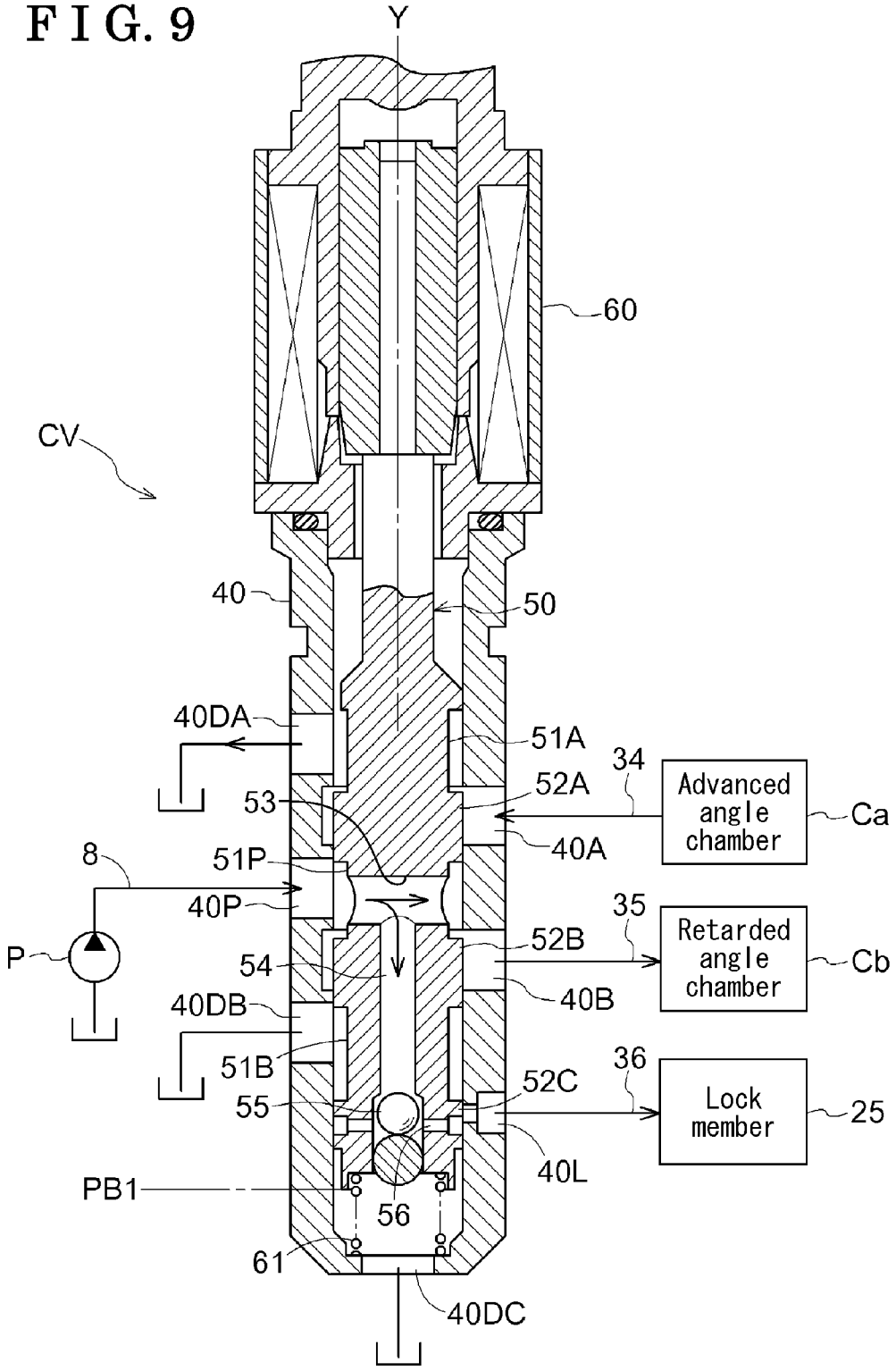
FIG. 9 is a cross-sectional view of the control valve in a first retarded angle position according to the first embodiment disclosed here.
Figure 10:
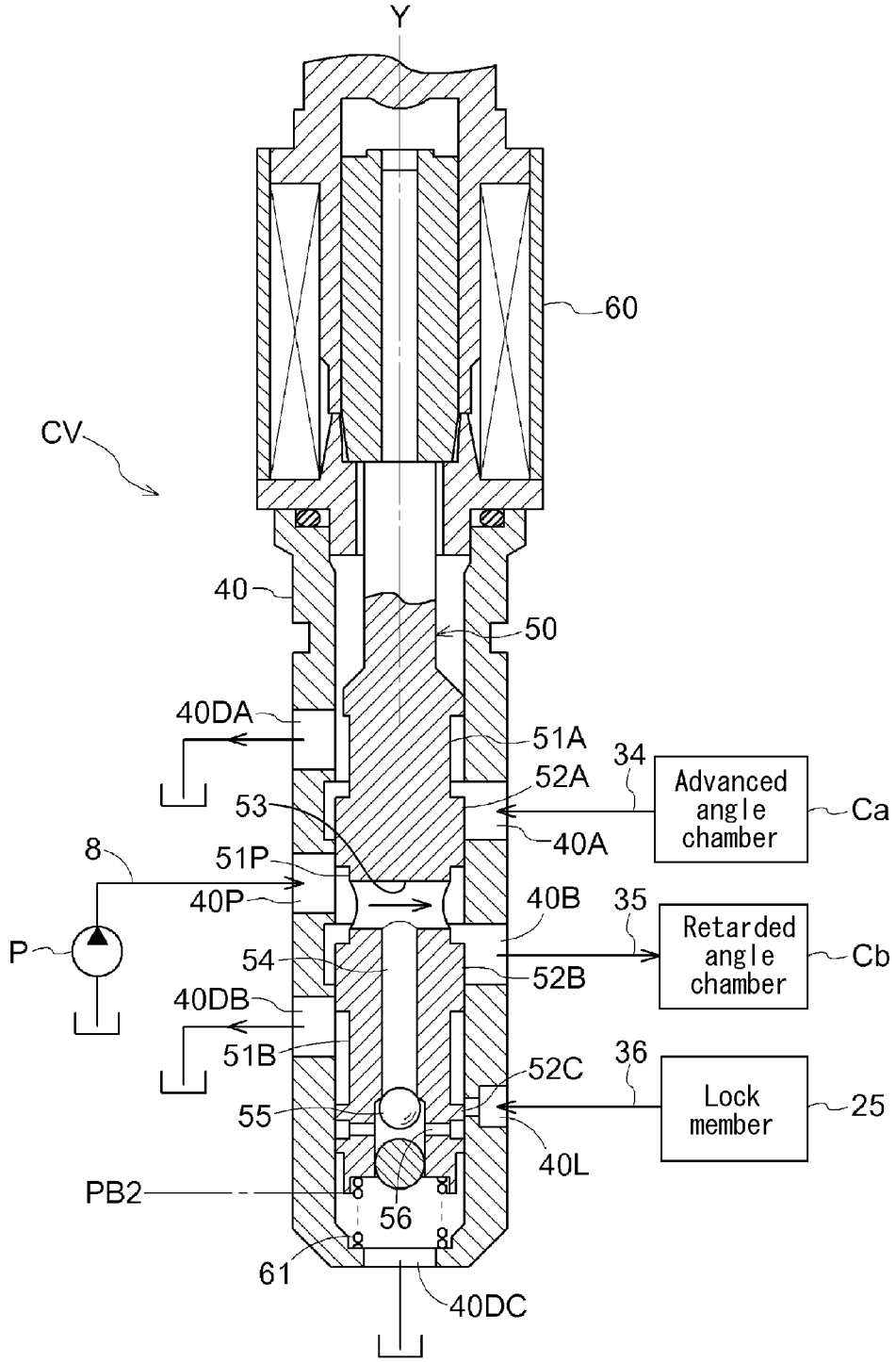
FIG. 10 is a cross-sectional view of the control valve in a second retarded angle position according to the first embodiment disclosed here.

At the second advanced angle position PA2, as illustrated in FIG. 6, the operation oil is supplied only to the advanced angle port 40A, and the operation oil is drained from the unlocking port 40L and the retarded angle port 40B. At the first advanced angle position PA1, as illustrated in FIG. 7, the operation oil is supplied to the advanced angle port 40A and the unlocking port 40L, and the operation oil is drained from the retarded angle port 40B. At the unlock position PL, as illustrated in FIG. 8, the operation oil is supplied only to the unlocking port 40L, and the advanced angle port 40A and the retarded angle port 40B are closed (supply and exhaust of the operation oil is blocked). At the first retarded angle position PB1, as illustrated in FIG. 9, the operation oil is supplied to the retarded angle port 40B and the unlocking port 40L, and the operation oil is drained from the advanced angle port 40A. At the second retarded angle position PB2, as illustrated in FIG. 10, the operation oil is supplied only to the retarded angle port 40B, and the operation oil is drained from the advanced angle port 40A and the unlocking port 40L.

According to the first embodiment, the spool 50 establishes the second advanced angle position PA2 in a state where the electric power is not supplied to the solenoid mechanism 60, and the state, or the position of the spool 50 is changed to the first advanced angle position PA1, the unlock position PL, the first retarded angle position PB1, and the second retarded angle position PB2 in the mentioned order by increasing the electric power supplied to the solenoid mechanism 60 by a predetermined value.

Particularly, by providing the plural positions, by the reduction of the electric current value supplied to the solenoid mechanism 60 by a predetermined value, the state of the spool 50 is changed from a state where the spool 50 is operated at the unlock position PL at the center position to the first advanced angle position PA1, and further to the second advanced angle position PA2. Similarly, by the increase of the electric current value supplied to the solenoid mechanism 60 by a predetermined value, the state of the spool 50 is changed from the state where the spool 50 is operated at the unlock position PL at the center position to the first retarded angle position PB1, and further to the second retarded angle position PB2.

The second advanced angle position will be explained in more detail hereinafter. In a state where the electric power is not supplied to the solenoid mechanism 60, the spool 50 is positioned at the second advanced angle position PA2 shown in FIG. 6. At the second advanced angle position PA2, the operation oil supplied to the pump port 40P is supplied to the advanced angle port 40A via the phase control fluid passage 53 and the pump side groove portion 51P on the basis of the positional relationship between the first land portion 52A and the advanced angle port 40A. The operation oil from the retarded angle port 40B is drained, or can be drained to the second drain port 40DB via the second groove portion 51B on the basis of the positional relationship between the second land portion 52B and the retarded angle port 40B. The operation oil from the unlocking port 40L is drained from the third drain port 40DC.

According to the construction described above, the operation oil is supplied from the advanced angle port 40A to the advanced angle chamber Ca via the advanced angle fluid passage 34, and the operation oil in the retarded angle chamber Cb flows to the retarded angle port 40B via the retarded angle fluid passage 35 so as to be drained from the second drain port 40DB. In consequence, the relative rotational phase is displaced in the advanced angle direction Sa. Further, because the operation oil in the lock control fluid passage 54 is drained, when the relative rotational phase reaches the intermediate lock phase by the lock mechanism L during the displacement in the advanced angle direction Sa, the lock members 25 serving as a pair may engage with the intermediate lock recessed portion 37 by means of the biasing force of the lock spring 26 to lock at the intermediate lock phase.

The first advanced angle position will be explained in detail hereinafter. As illustrated in FIG. 7, at the first advanced angle position PA1, similarly to the second advanced angle position PA2, the operation oil supplied to the pump port 40P is supplied to the advanced angle port 40A via the phase control fluid passage 53 and the pump side groove portion 51P on the basis of the positional relationship between the first land portion 52A and the advanced angle port 40A. Further, the operation oil from the retarded angle port 40B is drained to the second drain port 40DB via the second groove portion 51B on the basis of the positional relationship between the second land portion 52B and the retarded angle port 40B.

Further, at the first advanced angle portion PA1, because the lock operation fluid passage 56 is positioned so as to be in communication with the unlocking port 40L, the operation oil pressure is applied to the lock control fluid passage 54 that diverges from the phase control fluid passage 53 to open the check valve 55 for maintaining unlocked state, thus supplying the operation oil to the unlocking port 40L.

Accordingly, the operation oil is supplied from the advanced angle port 40A to the advanced angle chamber Ca via the advanced angle fluid passage 34, and the operation oil in the retarded angle chamber Cb flows to the retarded angle port 40B via the retarded angle fluid passage 35 to be drained from the second drain port 40DB. In consequence, the relative rotational phase displaces in the advanced angle direction Sa. Further, in a case where the relative rotational phase is positioned at the intermediate lock phase, the operation oil pressure from the unlocking port 40L is applied to the lock members 25 serving as a pair via the lock operation fluid passage 56, and the lock members 25 are shifted against the biasing force of the lock spring 26 to unlock the lock mechanism L.

Further, when the spool 50 is positioned at the first advanced angle position PA1, the lock members 25 are disengaged from an outer circumferential surface of the inner rotor 30. Thus, the relative rotational phase can be displaced in the advanced angle direction Sa in a state where the resistance caused at the inner rotor 30 by the lock members 25 is eliminated.

The unlock position PL will be explained in detail hereinafter. As illustrated in FIG. 8, at the unlock position PL, the first land portion 52A closes the advanced angle port 40A, and the second land portion 52B closes the retarded angle port 40B. Simultaneously, the lock operation fluid passage 56 is positioned so as to be in communication with the unlocking port 40L (the lock operation fluid passage 56 comes to communicate with the unlocking port 40L when the spool 50 is at the unlock position PL). That is, the operation oil is blocked at the advanced angle port 40A and the retarded angle port 40B, the operation oil pressure is applied to the lock control fluid passage 54 that is diverged from the phase control fluid passage 53 to open the check valve 55 for maintaining unlocked state, then, the operation oil is supplied to the unlocking port 40L.

At the unlock position PL, in a case where the relative rotational phase is at the intermediate lock phase, the operation oil from the unlocking port 40L is applied to the lock members 25 serving as a pair via the lock operation fluid passage 56, and shifts the lock members 25 against the lock spring 26 to unlock the lock mechanism L.

The first retarded angle position will be explained in detail hereinafter. As illustrated in FIG. 9, at the first retarded angle position PB1, the operation oil supplied to the pump port 40P is supplied to the retarded angle port 40B via the phase control fluid passage 53 on the basis of the positional relationship between the second land portion 52B and the retarded angle port 40B. Further, the operation oil from the advanced angle port 40A is drained to the first drain port 40DA via the first groove portion 51A on the basis of the positional relationship between the first land portion 52A and the advanced angle port 40A.

Further, at the first retarded angle position PB1, because the lock operation fluid passage 56 is positioned so as to be in communication with the unlocking port 40L (because the lock operation fluid passage 56 comes to communicate with the unlocking port 40L), the operation oil pressure is applied to the lock control fluid passage 54 that diverges from the phase control fluid passage 53 to open the check valve 55 for maintaining unlocked state, then the operation oil is supplied to the unlocking port 40L.

Accordingly, the operation oil is supplied from the retarded angle port 40B to the retarded angle chamber Cb via the retarded angle fluid passage 35, and the operation oil in the advanced angle chamber Ca flows to the advanced angle port 40A via the advanced angle fluid passage 34 to be drained from the first drain port 40DA. In consequence, the relative rotational phase is displaced in the retarded angle direction Sb. Further, in a case where the relative rotational phase is at the intermediate lock phase, the operation oil from the unlocking port 40L is applied to the lock members 25 serving as a pair via the lock operation fluid passage 56, and shifts the lock members 25 against the biasing force of the lock spring 26 to unlock the lock mechanism L.

Further, at the first retarded angle position PB1, because the lock members 25 are disengaged from the outer circumferential surface of the inner rotor 30, the relative rotational phase can be displaced in the retarded angle direction Sb in a state where the resistance caused by the lock members 25 at the inner rotor 30 is eliminated.

The second retarded angle position will be explained hereinafter. As illustrated in FIG. 10, at the second retarded angle position PB2, similarly to the first retarded angle position PB1, the operation oil supplied to the pump port 40P is supplied to the retarded angle port 40B via the phase control fluid passage 53 and the pump side groove portion 51P on the basis of the positional relationship between the second land portion 52B and the retarded angle port 40B. Further, the operation oil from the advanced angle port 40A is drained to the first drain port 40DA via the first groove portion 51A on the basis of the positional relationship between the first land portion 52A and the advanced angle port 40A. Further, the operation oil from the unlocking port 40L is drained to the second drain port 40DB.

Accordingly, the operation oil is supplied from the retarded angle port 40B to the retarded angle chamber Cb via the retarded angle fluid passage 35, and the operation oil in the advanced angle chamber Ca flows to the advanced angle port 40A via the advanced angle fluid passage 34 to be drained from the first drain port 40DA. In consequence, the relative rotational phase displaces in the retarded angle direction Sb. Further, because the operation oil in the lock control fluid passage 54 is drained, in a case where the intermediate lock phase is established by the lock mechanism L (the relative rotational phase reaches the intermediate lock phase by the lock mechanism L) when the relative rotational phase displaces in the retarded angle direction Sb, the lock members 25 serving as a pair come to engage with the intermediate lock recessed portion 37 by means of the biasing force of the lock spring 26. When the relative rotational phase reaches the most retarded angle lock phase, one of the lock members 25 come to engage with the most retarded angle lock recessed portion 38 to establish a locked state.

Effects and advantages of the first embodiment will be explained as follows. According to the first embodiment, the lock control fluid passage 54 that supplies the operation oil to the unlocking port 40L when the spool 50 is positioned at any one of the first advanced angle position PA1, the unlock position PL, and the first retarded angle position PB1 is formed in a manner diverging from the phase control fluid passage 53 and in an attitude, or orientation along the spool axis Y inside the spool 50.

According to the construction explained above, without forming exclusive fluid passages for the first advanced angle position PA1, the unlock position PL, and the first retarded angle position PB1, the operation oil can be supplied to the ports that need the operation fluid via the single lock control fluid passage 54 when the spool 50 is operated to be positioned at any one of the first advanced angle position PA1, the unlock position PL, and the first retarded angle position PB1. Accordingly, there is no need to form great number of lands and plural ports that have the same functions, and thus downsizing the control valve CV per se.

Further, because the check valve 55 for maintaining unlocked state is provided at the lock control fluid passage 54, even when the pressure level of the operation oil supplied to the pump port 40P is temporarily declined, for example, during the operation oil is supplied to the unlocking fluid passage 36 from the unlocking port 40L, the operation oil is prevented from flowing in a reverse direction from the unlocking port 40P to the unlocking fluid passage 36 by closing the check valve 55 for maintaining unlocked state, thus maintaining the unlocked state of the lock mechanism L.

Further, according to the construction of the first embodiment, because the phase control fluid passage 53 is formed in the spool 50 in an orientation, or attitude being orthogonal to the spool axis Y, the operation fluid (operation oil) is supplied to the advanced angle port 40A via the phase control fluid passage 53 when the spool 50 is operated to either position, the first advanced angle portion PA1 and the second advanced angle position PA2. Further, the operation fluid is supplied to the retarded angle port 40B via the phase control fluid passage 53 when the spool 50 is operated to either position, the first retarded angle position PB1 and the second retarded angle position PB2. Thus, by forming the single phase control fluid passage 53 in the spool 50 in a manner being orthogonal to the spool axis Y, an increase in the number of land and port can be restrained.

A second embodiment will be explained hereinafter. Layouts of a valve case 40, a spool 50, an electromagnetic solenoid 60, and a spool spring 61 of a control valve CV according to the second embodiment are common to the first embodiment. The structure that a shaft portion 41 of the valve case 40 is positioned inside an inner rotor 30 is common to the first embodiment. According to the second embodiment, the position of ports formed on the valve case 40 and constructions of the spool 50 are different from those of the first embodiment. According to the second embodiment, the control valve CV is positioned at an upper portion of the valve case 40.

Figure 11:
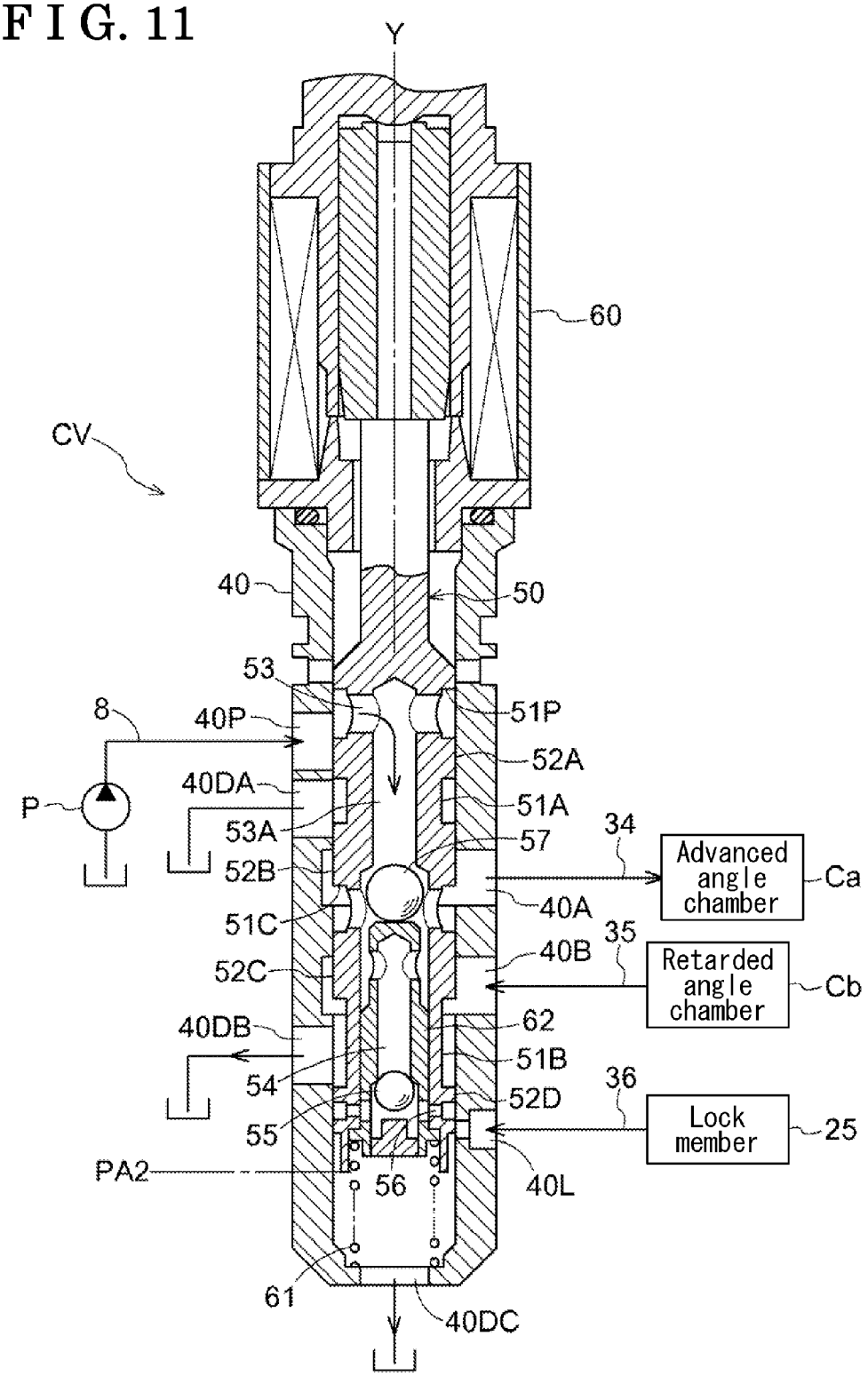
FIG. 11 is a cross-sectional view of a control valve in a second advanced angle position according to a second embodiment disclosed here.

According to the second embodiment, as illustrated in FIG. 11, a pump port 40P is arranged at the position closest to the electromagnetic solenoid 60 in a direction along the spool axis Y. Next to the pump port 40P, a first drain port 40DA, an advanced angle port 40A, a retarded angle port 40B, a second drain port 40DB, an unlocking port 40L, and a third drain port 40DC are positioned in a manner being away from the electromagnetic solenoid 60 in the mentioned order. The third drain port 40DC is positioned at a lower end portion of the valve case 40.

According to the second embodiment, the advanced angle port 40A is positioned at an upper portion and the retarded angle port 40B is positioned at a lower level than the advanced angle port 40A, however, the construction is not limited. Alternatively, the retarded angle port 40B may be positioned at an upper portion and the advanced angle port 40A may be positioned at a lower level than the retarded angle port 40B without changing the construction of the control valve CV.

At the spool 50, a pump side groove portion 51P having a smaller diameter is formed at an upper end position (the position closer to the electromagnetic solenoid 60) in the direction of the spool axis Y. At the lower level of the pump side groove portion 51P, a first groove portion 51A for drain having a smaller diameter, a control side groove portion 51C serving as a fluid distributing portion, and a second groove portion 51B are formed in the mentioned order.

At a lower level of the pump side groove portion 51P (in the direction opposite from the electromagnetic solenoid 60), a first land portion 52A, a second land portion 52B, a third land portion 52C, and a fourth land portion 52D are formed in the mentioned order. An outer diameter of the first land portion 52A, the second land portion 52B, the third land portion 52C, and the fourth land portion 52D is set, or determined at a value approximate to an inner diameter of the spool accommodation space of the valve case 40.

At a portion of the pump side groove portion 51P, a single phase control fluid passage 53 that is arranged orthogonally to the spool axis Y is formed. A diverging fluid passage 53A that diverges from an intermediate position of the phase control fluid passage 53 in a direction along the spool axis Y is formed inside the spool 50. A lock control fluid passage 54 is formed in an extended direction of the diverging fluid passage 53A. The diverging fluid passage 53A is in communication with the control side groove portion 51C (an example of the fluid distributing portion) and is provided with a check valve 57 for control that includes a ball and positioned closer to the phase control fluid passage 53 compared to the communicating position with the control side groove portion 51C. The phase control fluid passage 53 allows the supply of the operation oil to the advanced angle port 40A and the retarded angle port 40B.

A holder member 62 is provided at a downstream of the diverging fluid passage 53A, and the lock control fluid passage 54 is formed inside the holder member 62. A check valve 55 for maintaining unlocked state, which includes a ball, is provided at a downstream side in the lock control fluid passage 54. The lock control fluid passage 54 allows the supply of the operation oil to the unlocking port 40L.

A lock operation fluid passage 56 is formed on the spool 50 in a manner establishing a communication with an outer peripheral portion of the fourth land portion 52D and in an orientation, or attitude orthogonal to the spool axis Y. A portion at a downstream relative to the check valve 55 for maintaining unlocked state in the lock control fluid passage 54 is in communication with the lock operation fluid passage 56.

An operation of the control valve CV according to the second embodiment will be explained as follows. According to the second embodiment, the spool 50 is configured to be operated to a second advanced angle position PA2, a first advanced angle portion PA1, an unlock position PL, a first retarded angle position PB1, and a second retarded angle position PB2 in accordance with the setting of the electric power supplied to the electromagnetic solenoid 60 as illustrated in FIGS. 11 to 15. The supply and the exhaust of the operation oil at the second advanced angle position PA2, the first advanced angle portion PA1, the unlock position PL, the first retarded angle position PB1, and the second retarded angle position PB2 are common to the first embodiment.

According to the second embodiment, the spool 50 is positioned at the second advanced angle position PA2 in a state where the electric power is not supplied to the electromagnetic solenoid 60, and the position of the spool 50 is switched to the first advanced angle portion PA1, the unlock position PL, the first retarded angle position PB1, and the second retarded angle position PB2 in the mentioned order by increasing the electric power supplied to the electromagnetic solenoid 60 by a predetermined value.

The second advanced angle position will be explained in more detail hereinafter. In a state where the electric power is not supplied to the solenoid mechanism 60, the spool 50 is positioned at the second advanced angle position PA2 shown in FIG. 11. At the second advanced angle position PA2, the operation oil supplied to the pump port 40P is supplied to the advanced angle port 40A via the phase control fluid passage 53, the diverging fluid passage 53A, and the control side groove portion 51C on the basis of the positional relationship between the second land portion 52B and the advanced angle port 40A. The operation oil from the retarded angle port 40B is drained to the second drain port 40DB via the second groove portion 51B on the basis of the positional relationship between the third land portion 52C and the retarded angle port 40B. The operation oil from the unlocking port 40L is drained from the third drain port 40DC.

Thus, when the operation oil is supplied from the diverging fluid passage 53A to the lock control fluid passage 54, the check valve 57 for control is released, or opened by the operation oil pressure (hydraulic pressure) so that the operation oil is supplied to the advanced angle port 40A.

Figure 12:
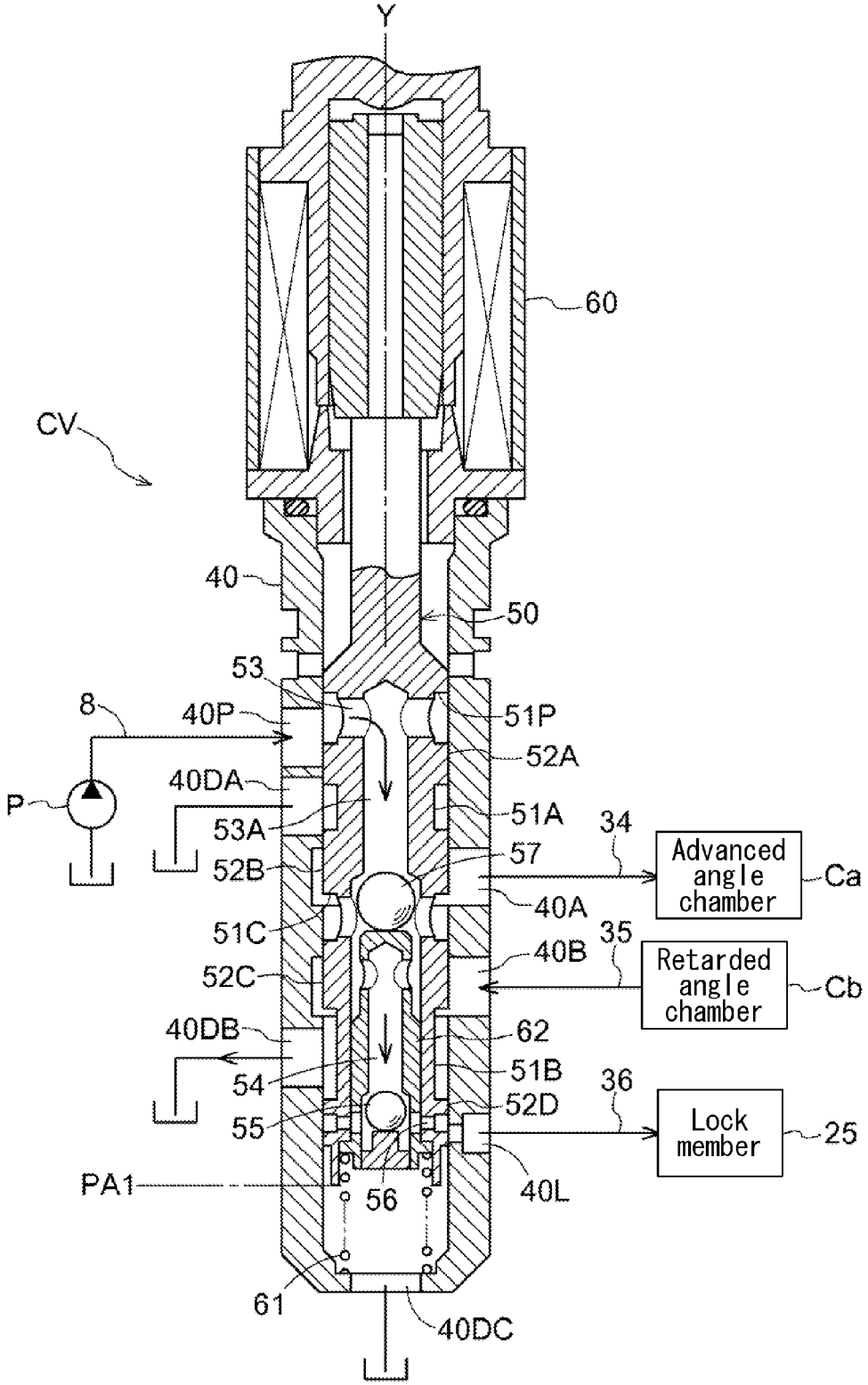
FIG. 12 is a cross-sectional view of the control valve in a first advanced angle position according to the second embodiment disclosed here.

The first advanced angle position will be explained in detail hereinafter. As illustrated in FIG. 12, at the first advanced angle position PA1, similarly to the second advanced angle position PA2, the operation oil supplied to the pump port 40P is supplied to the advanced angle port 40A via the phase control fluid passage 53, the diverging fluid page 53A, and the control side groove portion 51C on the basis of the positional relationship between the first land portion 52A and the advanced angle port 40A. Further, the operation oil from the retarded angle port 40B is drained to the second drain port 40DB via the second groove portion 51B on the basis of the positional relationship between the third land portion 52C and the retarded angle port 40B.

Further, at the first advanced angle portion PA1, because the lock operation fluid passage 56 is positioned so as to be in communication with the unlocking port 40L, the operation oil pressure is applied to the phase control fluid passage 53, the diverging fluid passage 53A, and the lock control fluid passage 54 to open the check valve 55 for maintaining unlocked state, thus supplying the operation oil to the unlocking port 40L.

Figure 13:
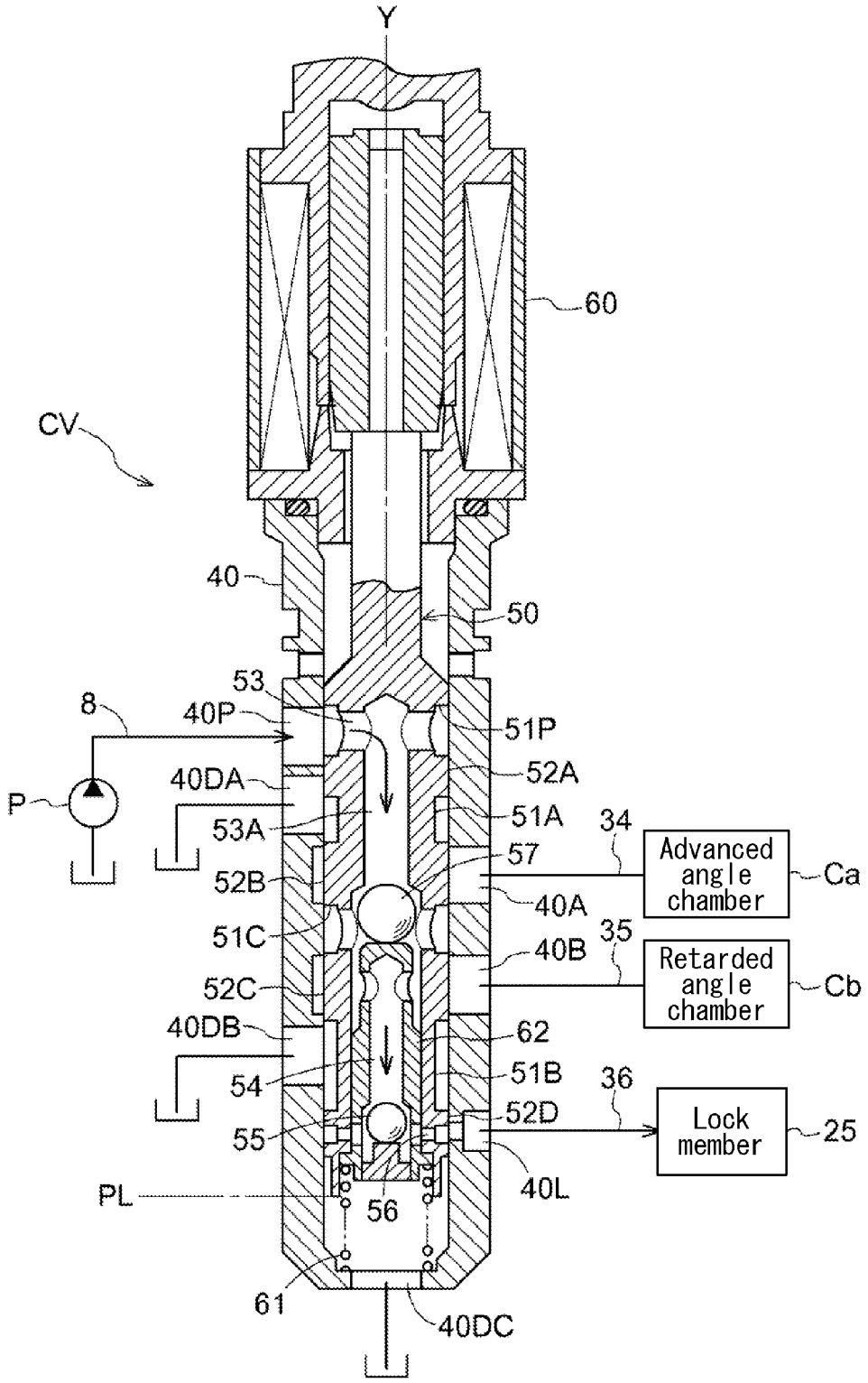
FIG. 13 is a cross-sectional view of the control valve in an unlocked position according to the second embodiment disclosed here.

The unlock position PL will be explained in detail hereinafter. As illustrated in FIG. 13, at the unlock position PL, the second land portion 52B closes the advanced angle port 40A, and the third land portion 52C closes the retarded angle port 40B. Further, the lock operation fluid passage 56 is positioned so as to be in communication with the unlocking port 40L (the lock operation fluid passage 56 comes to communicate with the unlocking port 40L when the spool 50 is at the unlock position PL). That is, the operation oil is blocked at the advanced angle port 40A and the retarded angle port 40B, the operation oil pressure is applied to the lock control fluid passage 54 from the diverging fluid passage 53A that is diverged from the phase control fluid passage 53 to open the check valve 55 for maintaining unlocked state, then, the operation oil is supplied to the unlocking port 40L.

At the unlock position PL, the check valve 57 for control and the check valve 55 for maintaining unlocked state are opened to supply the operation oil to the unlocking port 40L.

Figure 14:
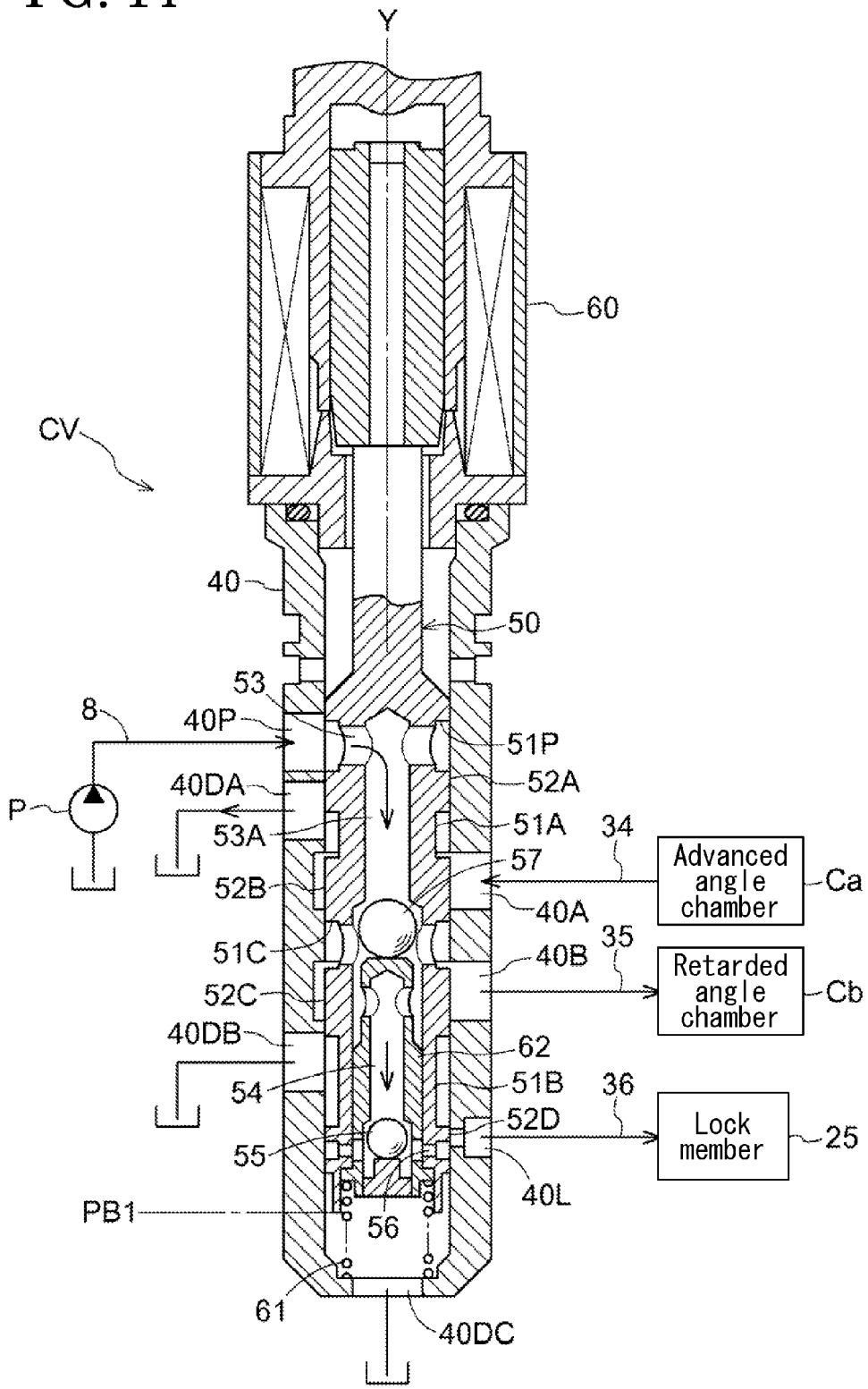
FIG. 14 is a cross-sectional view of the control valve in a first retarded angle position according to the second embodiment disclosed here.

The first retarded angle position will be explained in detail hereinafter. As illustrated in FIG. 14, at the first retarded angle position PB1, the operation oil supplied to the pump port 40P is supplied to the retarded angle port 40B via the phase control fluid passage 53 and the diverging fluid passage 53A on the basis of the positional relationship between the third land portion 52C and the retarded angle port 40B. Further, the operation oil from the advanced angle port 40A is drained to the first drain port 40DA via the first groove portion 51A on the basis of the positional relationship between the second land portion 52B and the advanced angle port 40A.

Further, at the first retarded angle position PB1, because the lock operation fluid passage 56 is positioned so as to be in communication with the unlocking port 40L (because the lock operation fluid passage 56 comes to communicate with the unlocking port 40L), the operation oil pressure is applied to the lock control fluid passage 54 from the diverging fluid passage 53A that diverges from the phase control fluid passage 53 to open the check valve 55 for maintaining unlocked state, then the operation oil is supplied to the unlocking port 40L.

Figure 15:
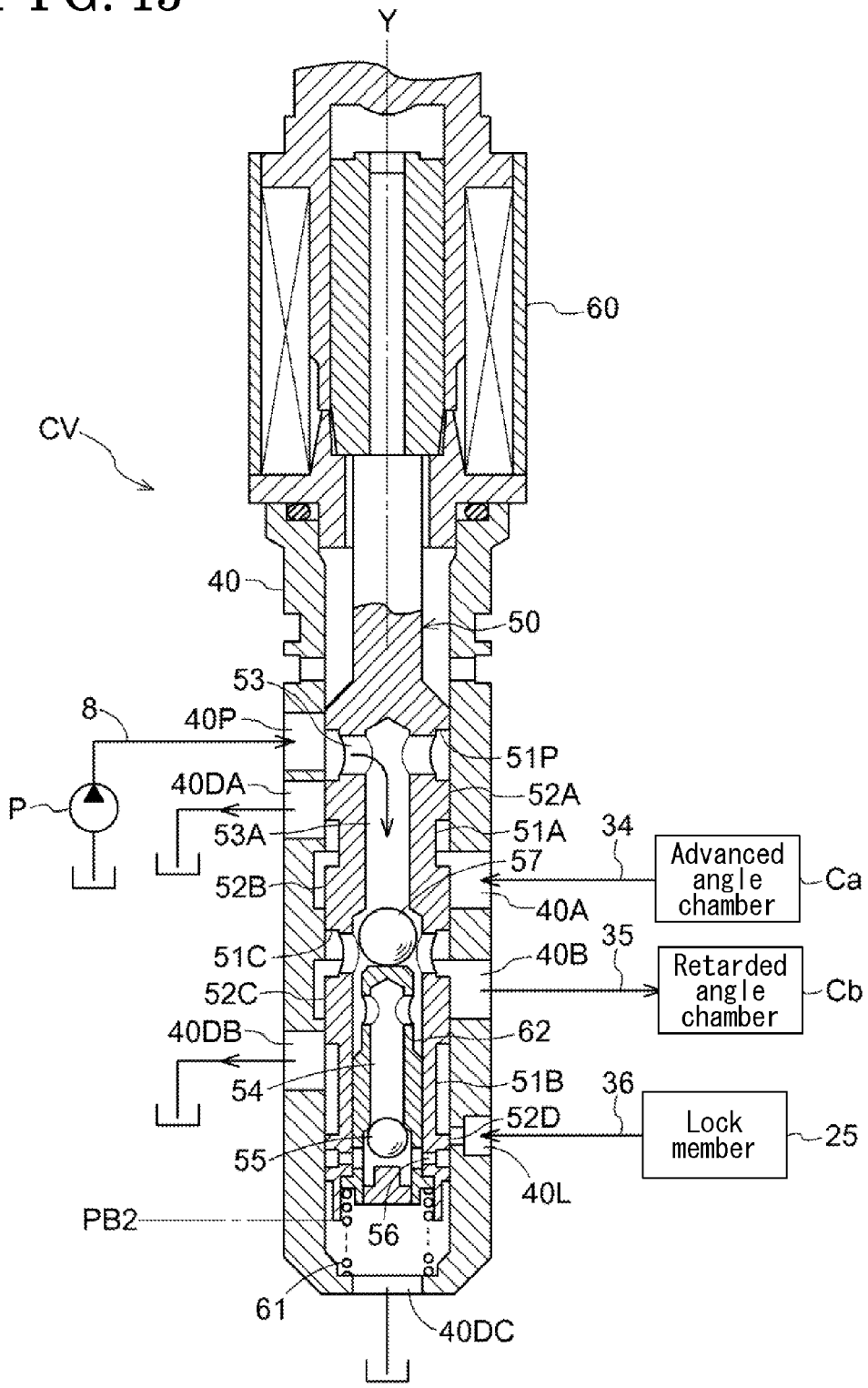
FIG. 15 is a cross-sectional view of the control valve in a second retarded angle position according to the second embodiment disclosed here.

The second retarded angle position will be explained hereinafter. As illustrated in FIG. 15, at the second retarded angle position PB2, similarly to the first retarded angle position PB1, the operation oil supplied to the pump port 40P is supplied to the retarded angle port 40B via the phase control fluid passage 53 and the diverging fluid passage 53A on the basis of the positional relationship between the second land portion 52B and the retarded angle port 40B. Further, the operation oil from the advanced angle port 40A is drained to the first drain port 40DA via the first groove portion 51A on the basis of the positional relationship between the second land portion 52B and the advanced angle port 40A. Further, the operation oil from the unlocking port 40L is drained to the second drain port 40DB.

Advantages and effects of the second embodiment will be explained as follows. According to the second embodiment, because the check valve 57 for control is provided at the lock control fluid passage 54, even if the pressure level of the operation oil supplied to the pump port 40P is temporarily declined, the displacement of the relative rotational phase is restrained by preventing the operation oil from draining, for example, when the operation oil is supplied from the advanced angle port 40A to the advanced angle chamber Ca or when the operation oil is supplied from the retarded angle port 40B to the retarded angle chamber Cb.

According to the second embodiment, the single lock control fluid passage 54 that is arranged along the spool axis Y and diverges from the intermediate position of the phase control fluid passage 53 arranged orthogonally to the spool axis Y is provided. Further, the lock control fluid passage 54 is provided with the check valve 55 for maintaining unlocked state. Thus, the same advantages and effects to the first embodiment associated with the lock control fluid passage 54 and the check valve 55 for maintaining unlocked state can be attained.

A control valve CV according to a third embodiment will be explained as follows. Layouts of a valve case 40, a spool 50, an electromagnetic solenoid 60, and a spool spring 61 of a control valve CV according to the third embodiment are common to the first and second embodiments. The structure that a shaft portion 41 of the valve case 40 is positioned inside an inner rotor 30 is common to the first and second embodiments. According to the third embodiment, the position of ports formed on the valve case 40 and constructions of the spool 50 are different from those of the first and second embodiments. According to the third embodiment, the control valve CV is positioned at an upper portion of the valve case 40.

Figure 16:
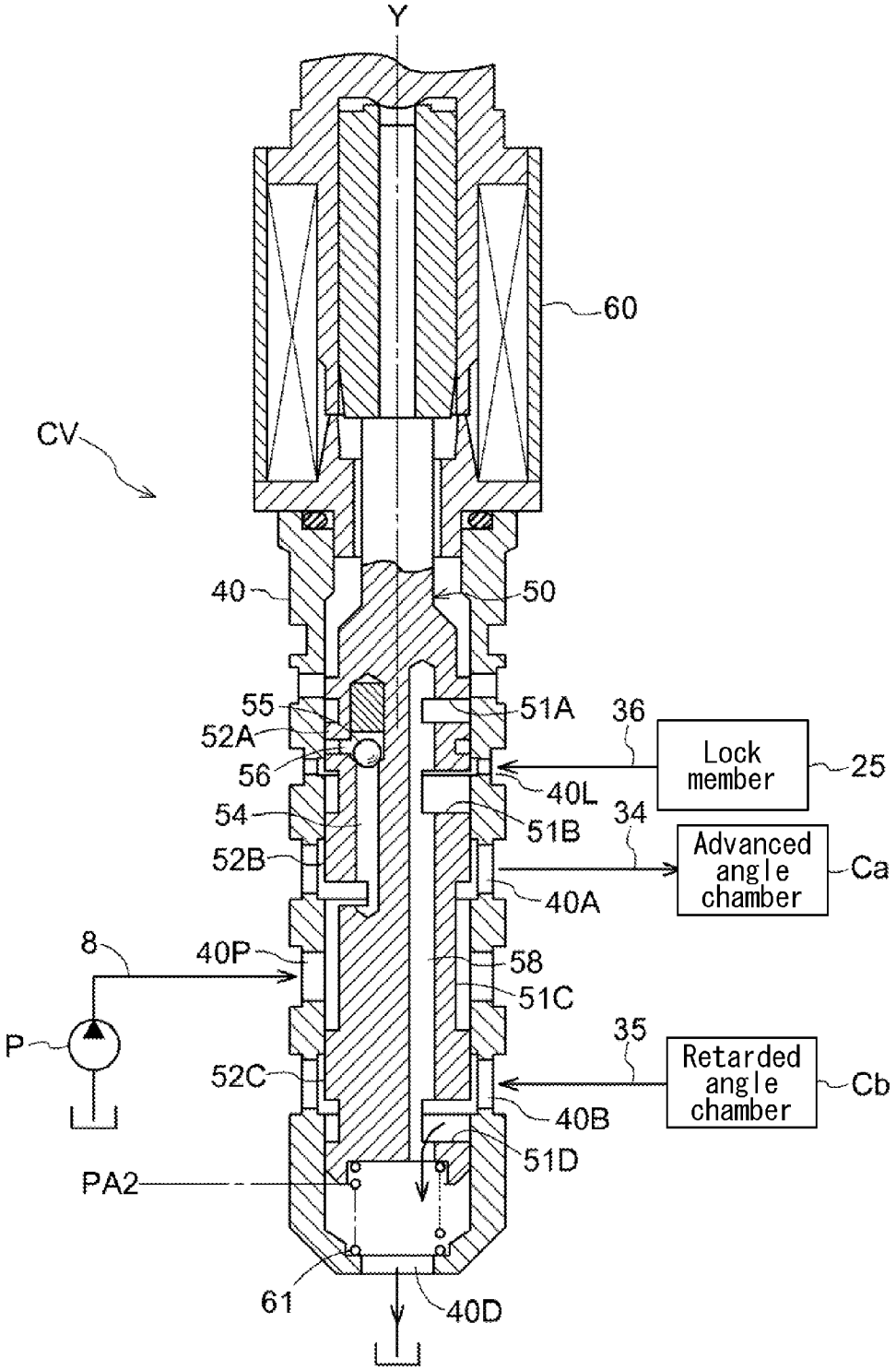
FIG. 16 is a cross-sectional view of a control valve in a second advanced angle position according to a third embodiment disclosed here.

According to the third embodiment, as illustrated in FIG. 16, an unlocking port 40L is arranged at the position closest to the electromagnetic solenoid 60 in a direction along a spool axis Y among the ports. Next to the unlocking port 40L, an advanced angle port 40A, a pump port 40P, a retarded angle port 40B, are positioned in a manner being away from the electromagnetic solenoid 60 in the mentioned order. A drain port 40D is positioned at a lower end portion of the valve case 40.

According to the third embodiment, the advanced angle port 40A is positioned at an upper portion and the retarded angle port 40B is positioned at a lower level than the advanced angle port 40A, however, the construction is not limited. Alternatively, the retarded angle port 40B may be positioned at an upper portion and the advanced angle port 40A may be positioned at a lower level than the retarded angle port 40B without changing the construction of the control valve CV.

At the spool 50, a first groove portion 51A having a smaller diameter is formed at an upper end position (the position closer to the electromagnetic solenoid 60) in the direction of the spool axis Y. At the lower level of first groove portion 51A, a second groove portion 51B, a control side groove portion 51C, and a third groove portion 51C are formed in the mentioned order.

At a lower level of the first groove portion 51A (in the direction opposite from the electromagnetic solenoid 60), a first land portion 52A, a second land portion 52B, a third land portion 52C are formed in the mentioned order. An outer diameter of the first land portion 52A, the second land portion 52B, the third land portion 52C is set, or determined at a value approximate to an inner diameter of the spool accommodation space of the valve case 40.

A drain fluid passage 58 that penetrates a lower end (the side opposite from the electromagnetic solenoid 60) of the spool 50 is formed inside the spool 50 in an orientation, or attitude along the spool axis Y. The drain fluid passage 58 is in communication with the first groove portion 51A, the second groove portion 51B, and the third groove portion 51D.

A lock control fluid passage 54 is formed within the spool 50 along the spool axis Yin a region extending from the first groove portion 51A to the control side groove portion 51C. One end of the lock control fluid passage 54 is in communication with the control side groove portion 51C. The other end of the lock control fluid passage 54 is provided with a check valve 55 for maintaining unlocked state that includes a ball. The lock control fluid passage 54 is further in communication with the lock operation fluid passage 56 that is arranged orthogonal to the spool axis Y. The check valve 55 for maintaining unlocked state is provided between the lock control fluid passage 54 and the lock operation fluid passage 56. The lock operation fluid passage 56 is in communication with an outer periphery portion of the first land portion 52A. The lock control fluid passage 54 allows the supply of the operation oil to the unlocking port 40L.

An operation of the control valve CV according to the third embodiment will be explained as follows. According to the third embodiment, the spool 50 is configured to be operated to a second advanced angle position PA2, a first advanced angle portion PA1, an unlock position PL, a first retarded angle position PB1, and a second retarded angle position PB2 in accordance with the setting of the electric power supplied to the electromagnetic solenoid 60 as illustrated in FIGS. 16 to 20. The supply and the exhaust of the operation oil at the second advanced angle position PA2, the first advanced angle portion PA1, the unlock position PL, the first retarded angle position PB1, and the second retarded angle position PB2 are common to the first embodiment.

According to the third embodiment, the spool 50 is positioned at the second advanced angle position PA2 in a state where the electric power is not supplied to the electromagnetic solenoid 60, and the position of the spool 50 is switched to the first advanced angle portion PA1, the unlock position PL, the first retarded angle position PB1, and the second retarded angle position PB2 in the mentioned order by increasing the electric power supplied to the electromagnetic solenoid 60 by a predetermined value.

The second advanced angle position will be explained in more detail hereinafter. In a state where the electric power is not supplied to the solenoid mechanism 60, the spool 50 is positioned at the second advanced angle position PA2 shown in FIG. 16. At the second advanced angle position PA2, the operation oil supplied to the pump port 40P is supplied to the advanced angle port 40A via the control side groove portion 51C on the basis of the positional relationship between the second land portion 52B and the advanced angle port 40A. The operation oil from the retarded angle port 40B is drained to the drain fluid passage 58 via the third groove portion 51D on the basis of the positional relationship between the third land portion 52C and the retarded angle port 40B, and thus being drained from the drain port 40D.

Figure 17:
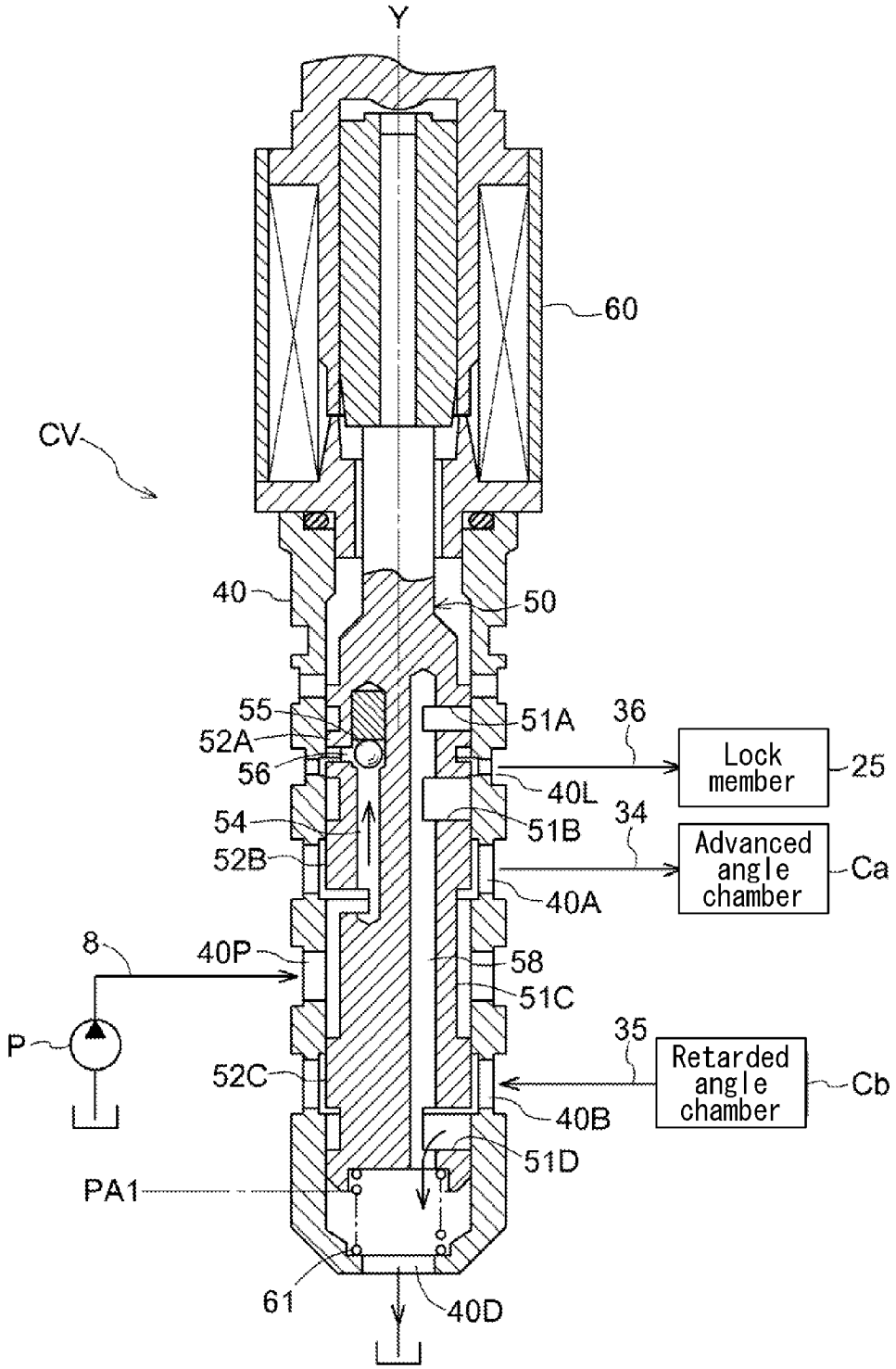
FIG. 17 is a cross-sectional view of the control valve in a first advanced angle position according to the third embodiment disclosed here.

The first advanced angle position will be explained in detail hereinafter. As illustrated in FIG. 17, at the first advanced angle position PA1, similarly to the second advanced angle position PA2, the operation oil supplied to the pump port 40P is supplied to the advanced angle port 40A via the control side groove portion 51C on the basis of the positional relationship between the first land portion 52A and the advanced angle port 40A. Further, the operation oil from the retarded angle port 40B is drained to the drain fluid passage 58 via the third groove portion 51D on the basis of the positional relationship between the third land portion 52C and the retarded angle port 40B, and thus being drained from the drain port 40D.

Further, at the first advanced angle portion PA1, because the lock operation fluid passage 56 is positioned so as to be in communication with the unlocking port 40L, the operation oil pressure is applied to the lock control fluid passage 54 that diverges from the control side groove portion 51C to open the check valve 55 for maintaining unlocked state, thus supplying the operation oil to the unlocking port 40L.

Figure 18:
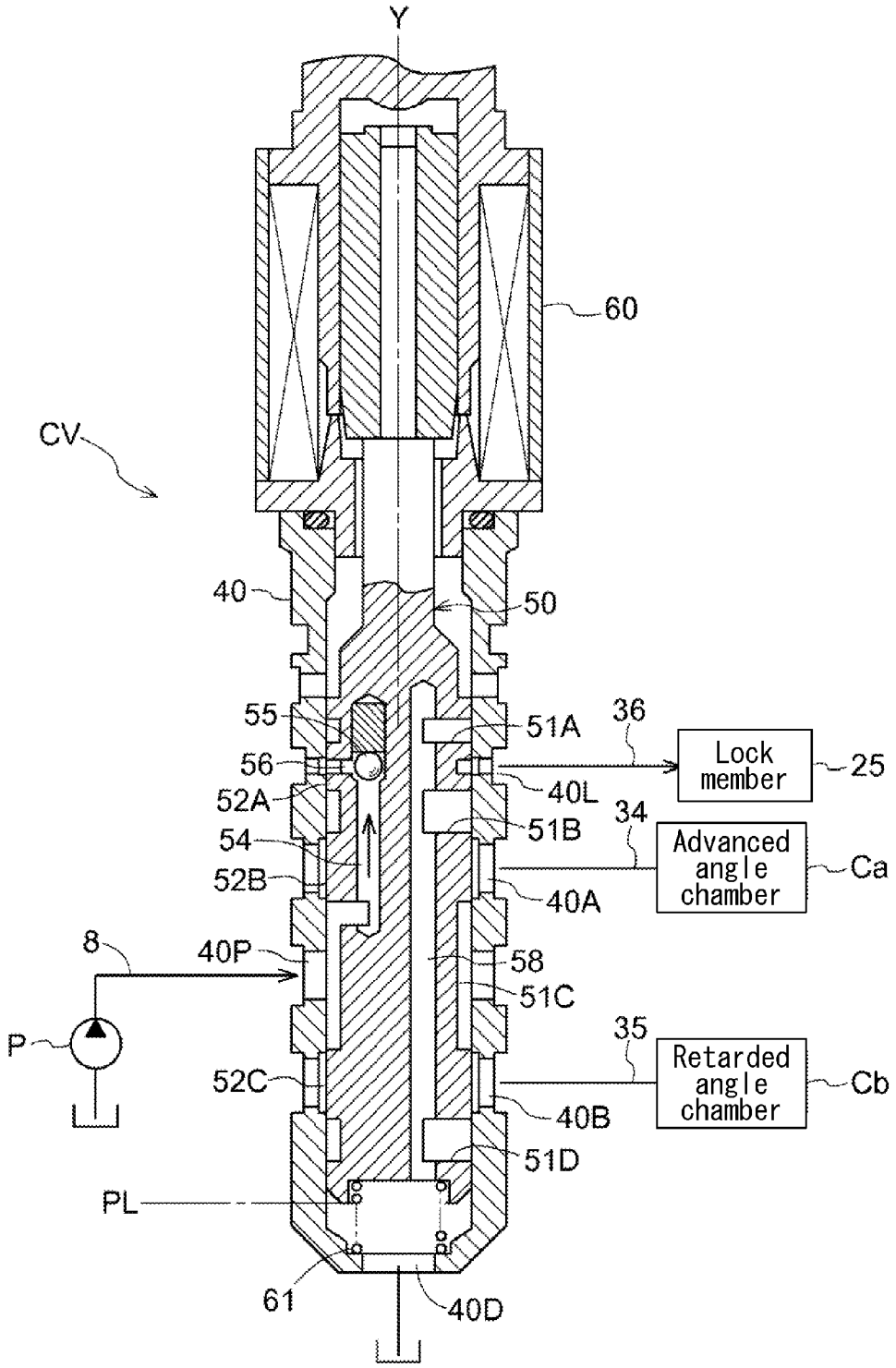
FIG. 18 is a cross-sectional view of the control valve in an unlocked position according to the third embodiment disclosed here.

The unlock position PL will be explained in detail hereinafter. As illustrated in FIG. 18, at the unlock position PL, the second land portion 52B closes the advanced angle port 40A, and the third land portion 52C closes the retarded angle port 40B. Further, the lock operation fluid passage 56 is positioned so as to be in communication with the unlocking port 40L (the lock operation fluid passage 56 comes to communicate with the unlocking port 40L when the spool 50 is at the unlock position PL). That is, the operation oil is blocked at the advanced angle port 40A and the retarded angle port 40B, the operation oil pressure is applied to the lock control fluid passage 54 that is diverged from the control side groove portion 51C to open the check valve 55 for maintaining unlocked state, then, the operation oil is supplied to the unlocking port 40L.

Figure 19:
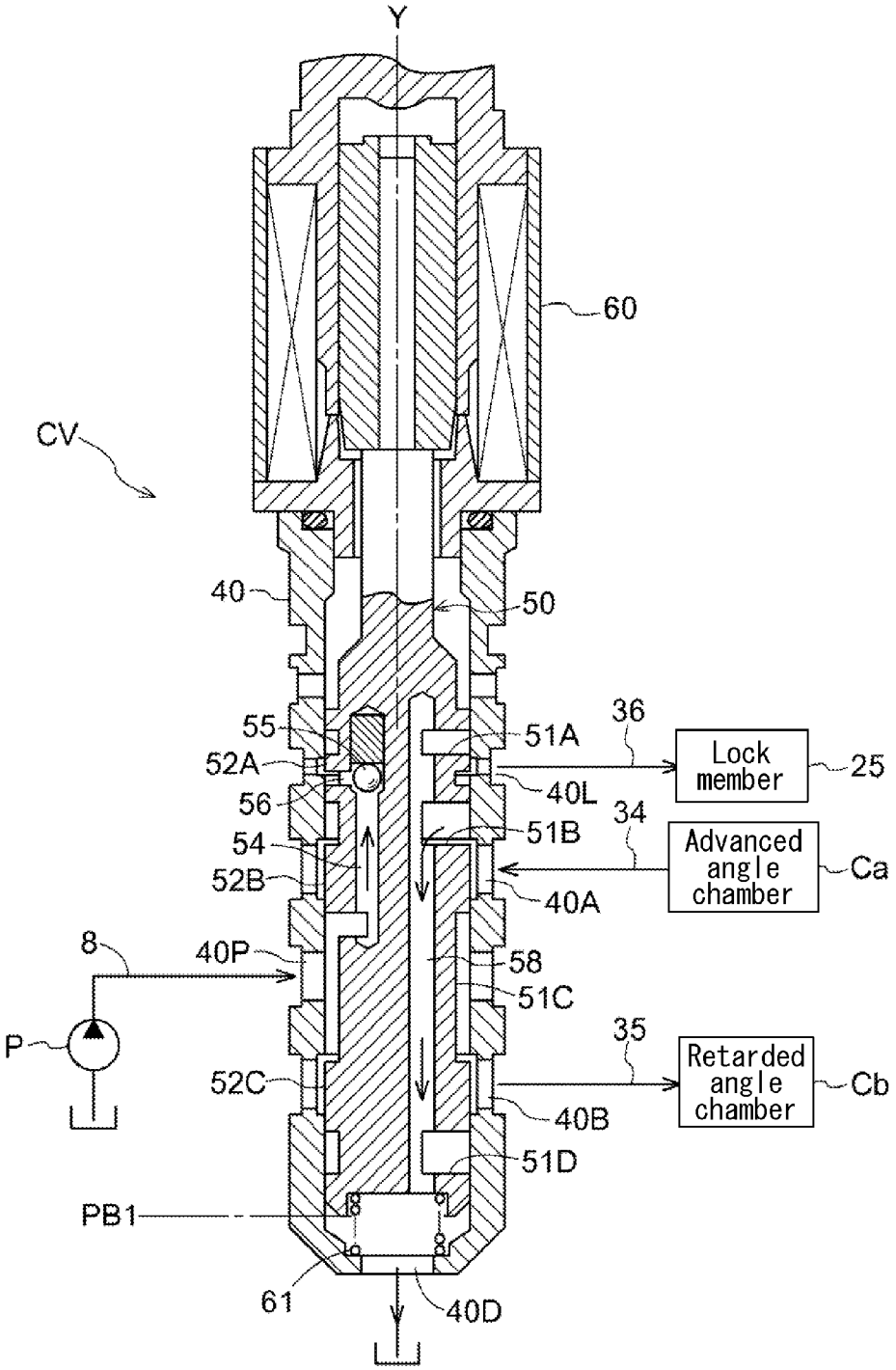
FIG. 19 is a cross-sectional view of the control valve in a first retarded angle position according to the third embodiment disclosed here.

The first retarded angle position will be explained in detail hereinafter. As illustrated in FIG. 19, at the first retarded angle position PB1, the operation oil supplied to the pump port 40P is supplied to the retarded angle port 40B via the control side groove portion 51C on the basis of the positional relationship between the third land portion 52C and the retarded angle port 40B. Further, the operation oil from the advanced angle port 40A is drained to the drain fluid passage 58 via the second groove portion 51B on the basis of the positional relationship between the second land portion 52B and the advanced angle port 40A, and thus being drained via the drain port 40D.

Further, at the first retarded angle position PB1, because the lock operation fluid passage 56 is positioned so as to be in communication with the unlocking port 40L (because the lock operation fluid passage 56 comes to communicate with the unlocking port 40L), the operation oil pressure is applied to the lock control fluid passage 54 that diverges from the control side groove portion 51C to open the check valve 55 for maintaining unlocked state, then the operation oil is supplied to the unlocking port 40L.

Figure 20:
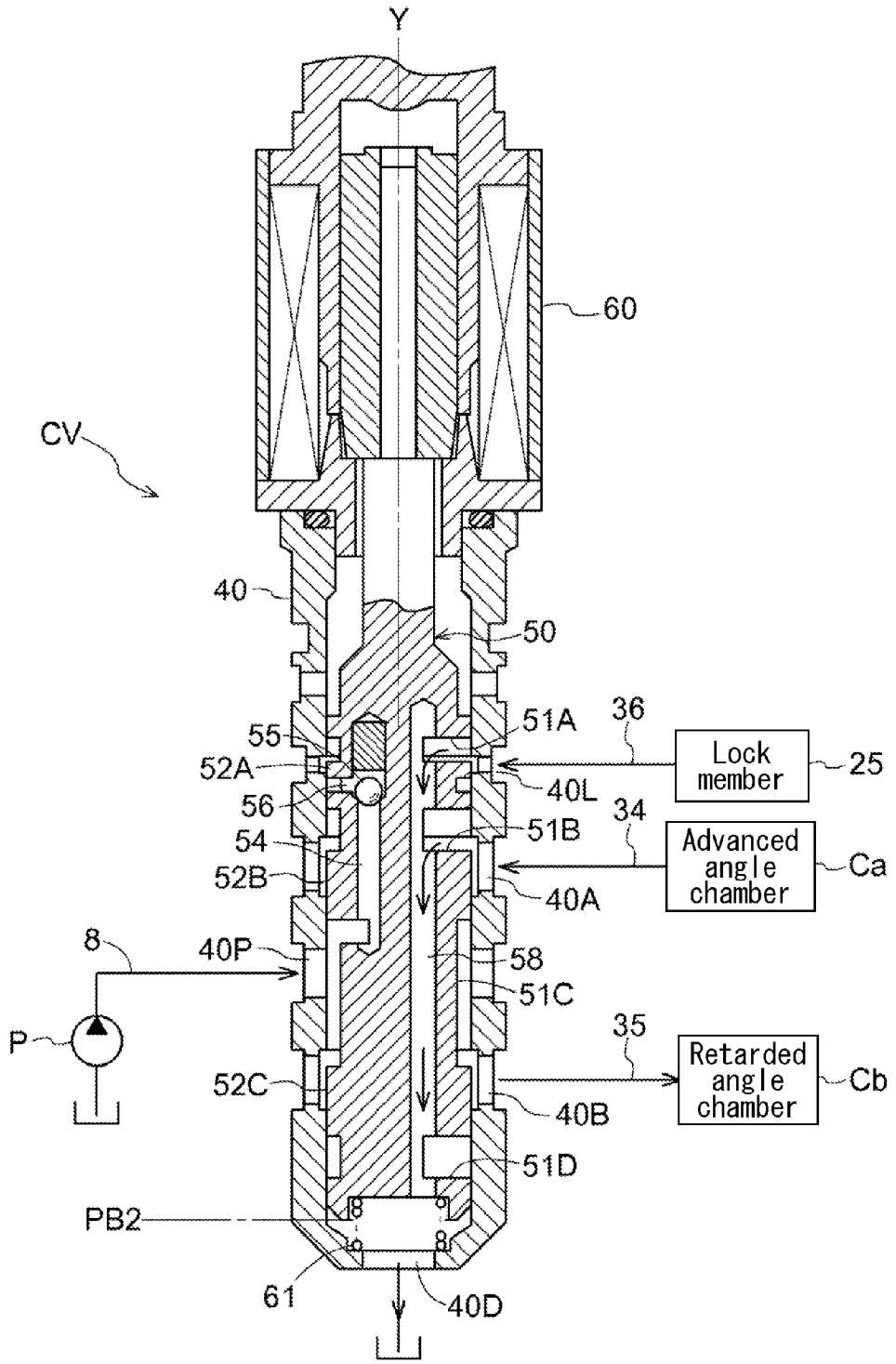
FIG. 20 is a cross-sectional view of the control valve in a second retarded angle position according to the third embodiment disclosed here.

The second retarded angle position will be explained hereinafter. As illustrated in FIG. 20, at the second retarded angle position PB2, similarly to the first retarded angle position PB1, the operation oil supplied to the pump port 40P is supplied to the retarded angle port 40B via the control side groove portion 51C on the basis of the positional relationship between the second land portion 52B and the retarded angle port 40B. Further, the operation oil from the advanced angle port 40A is drained to the drain fluid passage 58 via the second groove portion 51B on the basis of the positional relationship between the second land portion 52B and the advanced angle port 40A, thus being drained via the drain port 40D.

Advantages and effects of the third embodiment will be explained as follows. According to the third embodiment, the operation oil is supplied to the lock control fluid passage 54 via the control side groove portion 51C serving as a fluid diverging portion formed on an outer surface of the spool 50 with a smaller diameter, and the operation oil is supplied to the unlocking port 40L from the lock control fluid passage 54. Accordingly, because the pressure drop, or pressure loss of the operation oil is reduced at the control side groove portion 51C and a distance from the pump port 40P to the unlocking port 40L is shortened, the lock mechanism L can be unlocked swiftly.

Further, according to the third embodiment, because the drain fluid passage 58 is formed along the spool axis Y and all of the operation fluid that should be drained during the control can be drained from the drain fluid passage 58, there is no need to form plural openings for drain on the valve case 40.

According to the third embodiment, the check valve 55 for maintaining unlocked state is provided at the lock control fluid passage 54. Thus, the advantages and effects associated with the check valve 55 for maintaining unlocked state is common to the first embodiment.

Figure 21:
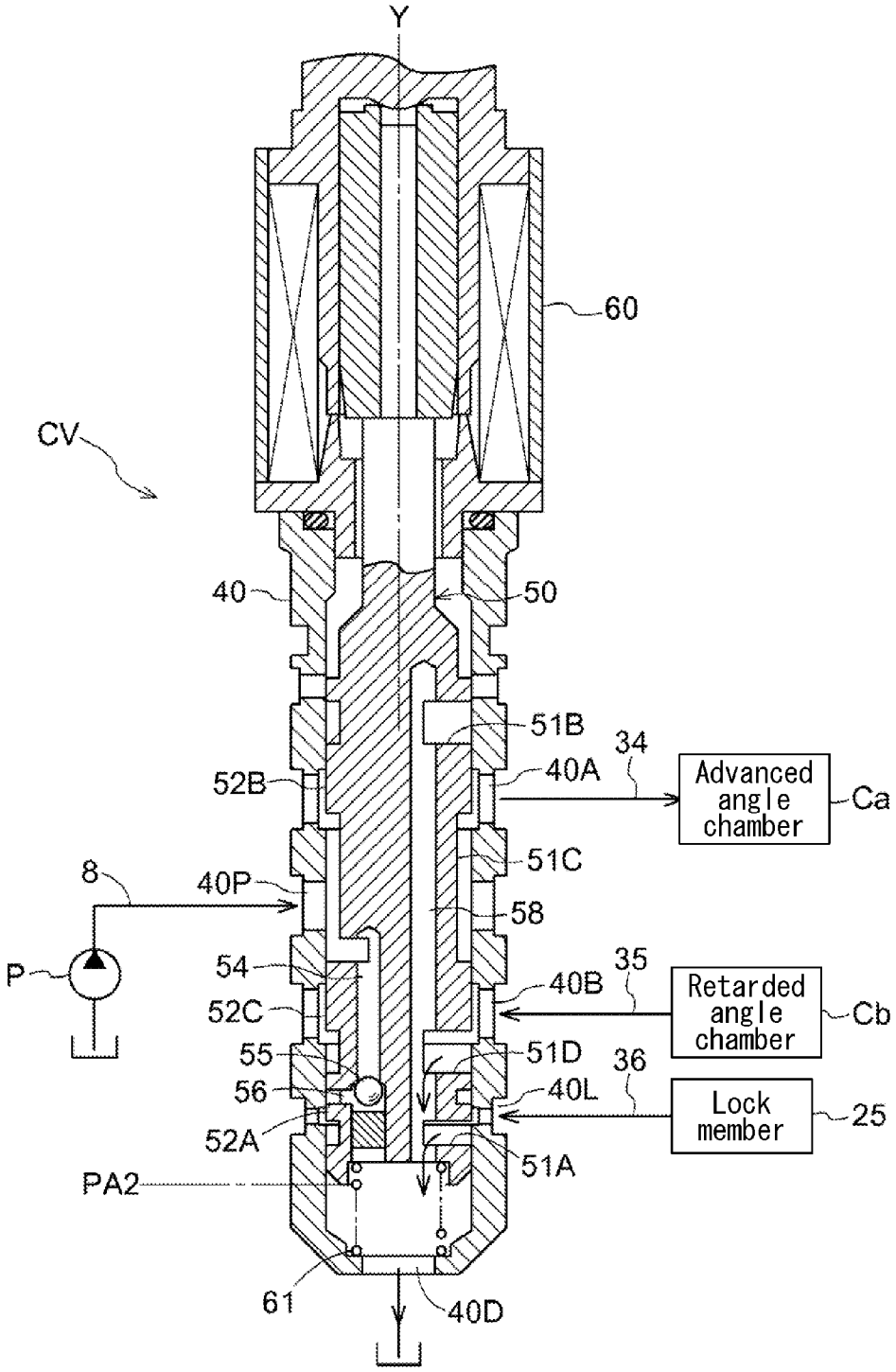
FIG. 21 is a cross-sectional view of a control valve in a second advanced angle position according to an alternative example of the control valve of the third embodiment.

A modified example of a control valve according to the third embodiment will be explained as follows. As illustrated in FIG. 21, the valve case 40 and the spool 50 of the modified example of the third embodiment are different from the third embodiment.

That is, according to the modified example, in the valve case 40, the unlocking port 40L is positioned at a lower end of the valve case 40 without changing the arranged order of the advanced angle port 40A, the pump port 40P, and the retarded angle port 40B.

At the spool 50 of the modified example, the first groove portion 51A is positioned at a lower end portion of the spool 50 without changing the arrangement order of the second groove portion 51B, the control side groove portion 51C, and the third groove portion 51D. Further, the first land portion 52A is positioned at an end portion of the spool 50 without changing an arrangement order of the second land portion 52B and the third land portion 52C.

The lock control fluid passage 54 and the check valve 55 for maintaining unlocked state are formed inside the spool 50. Further, the drain fluid passage 58 is formed inside the spool 50.

According to the modified example of the third embodiment, the advanced angle port 40A is positioned at an upper portion and the retarded angle port 40B is positioned at a level lower than the advanced angle port 40A, however, the construction is not limited. Alternatively, the retarded angle port 40B may be positioned at an upper portion and the advanced angle port 40A may be positioned at a level lower than the retarded angle port 40B without changing the structure of the control valve CV.

According to the construction of the modified example of the third embodiment, the operation oil can be controlled in a manner similar to the third embodiment.

The control valve of the disclosure can be applied to a variable valve timing control device for controlling an opening and closing timing of a camshaft of an internal combustion engine.

According to the embodiment, a control valve (CV) is provided for selectively supplying a fluid to one of an advanced angle chamber (Ca) and a retarded angle chamber (Cb) formed between a driving side rotation member (outer rotor 20) synchronously rotating with a crankshaft (1) of an internal combustion engine (E) and a driven side rotation member (inner rotor 30) integrally rotating with a camshaft (7) of the internal combustion engine (E), the driven side rotation member (inner rotor 30) relatively rotating to the driving side rotation member (outer rotor 20), the control valve (CV) for supplying a fluid for unlocking a lock member (25) checking a relative rotation of the driving side rotation member (outer rotor 20) and the driven side rotation member (inner rotor 30). The control valve includes a valve case (40), a spool (50) accommodated in the valve case (40), an electromagnetic solenoid (60) operating the spool (50) along a spool axis (Y) extending in a longitudinal direction, the valve case (40) including a pump port (40P) to which a fluid is supplied, an advanced angle port (40A) configured to be in communication with the advanced angle chamber (Ca), a retarded angle port (40B) configured to be in communication with the retarded angle chamber (Cb), and an unlocking port (40L) configured to be in communication with the lock member (25), the spool (50) being operated to at least five positions including a first advanced angle position (PA1) where the fluid is supplied to the advanced angle port (40A) and the unlocking port (40L), a second advanced angle position (PA2) where the fluid is supplied only to the advanced angle port (40A), an unlock position (PL) where the fluid is supplied only to the unlocking port (40L), a first retarded angle position (PB1) where the fluid is supplied to the retarded angle port (40B) and the unlocking port (40L), and a second retarded angle position (PB2) where the fluid is supplied only to the retarded angle port (40B), and a lock control fluid passage (54) formed inside the spool (50) in an attitude along the spool axis (Y), the lock control fluid passage (54) allowing the fluid from the pump port (40P) to be supplied only to the unlocking port (40L) irrespective of the position of the spool (50) when the spool (50) is operated to any one of the positions at which the fluid is supplied from the pump port (40P) to the unlocking port (40L).

According to the construction of the embodiment, the fluid can be supplied to the unlocking port (40L) via the lock control fluid passage (54) that is formed inside the spool (50) in a manner along the spool axis (Y) when the spool (50) is operated to any one of the first advanced angle position (PA1), the unlock position (PL), and the first retarded angle position (PB1) in any of which the fluid is supplied to the unlocking port (40L). That is, because the fluid can be supplied to the unlocking port (40L) by supplying the fluid to the single lock control fluid passage (54) irrespective of the position of the spool (50) including the first advanced angle position (PA1), the unlock position (PL), and the first retarded angle position (PB1), there is no need to form exclusive fluid passages corresponding to respective positions for supplying the fluid to the unlocking port (40L). Thus, there is no need to form great number of lands and plural ports having the same function. Particularly, because the lock control fluid passage (54) is formed as a fluid passage for exclusively supplying the fluid only to the unlocking port (40L), designing is easier and the length of the fluid passage can be shortened compared to a construction in which the fluid is supplied to and exhausted from other ports, for example. Accordingly, the control valve (CV) for performing a phase control and a lock control of a variable valve timing control device can be downsized.

According to the embodiment, the control valve (CV) includes a phase control fluid passage (53) formed at the spool (50) in an attitude orthogonal to the spool axis (Y), the phase control fluid passage (53) allowing the fluid to be supplied from the pump port (40P) to the advanced angle port (40A) irrespective of the position of the spool (50) operated to either one of the first advanced angle position (PA1) and the second advanced angle position (PA2), the phase control fluid passage (53) allowing the fluid to be supplied from the pump port (40P) to the retarded angle port (40B) irrespective of the position of the spool (50) operated to either one of the first retarded angle position (PB1) and the second retarded angle position (PB2).

According to the construction of the embodiment, the fluid can be supplied to the advanced angle port (40A) via the phase control fluid passage (53) irrespective of the position of the spool (50) operated to the first advanced angle position (PA1) and the second advanced angle position (PA2). Further, the fluid can be supplied to the retarded angle port (40B) via the phase control fluid passage (53) irrespective of the position of the spool (50) to the first retarded angle position (PB1) and the second retarded angle position (PB2). That is, according to the construction in which the single phase control fluid passage (53) is formed in a manner being orthogonal to the spool axis (Y), an increase in the number of lands and an increase in the number of ports can be restrained.

According to the embodiment, the lock control fluid passage (54) is formed at a position diverging from the phase control fluid passage (53) for supplying the fluid from the phase control fluid passage (53) to the unlocking port (40L) irrespective of the position of the spool (50) operated to any one of the first advanced angle position (PA1), the unlock position (PL), and the first retarded angle position (PB1).

According to the construction of the embodiment, the fluid diverged from the phase control fluid passage (53) is supplied to the lock control fluid passage (54) and further to the unlocking port (40L) irrespective of the position of the spool (50) to any one of the first advanced angle position (PA1), the unlock position (PL), and the first retarded angle position (PB1).

According to the embodiment, the advanced angle port (40A), the pump port (40P), and the retarded angle port (40B) are arranged at the valve case (40) in the mentioned order in a direction along the spool axis (Y) and the unlocking port (40L) is arranged at a position having a predetermined distance from one of end portions of the advanced angle port (40A) and the retarded angle port (40B), the end portions of the advanced angle port (40A) and the retarded angle port (40B) positioned being furthest each other in a direction of the spool axis (Y). The control valve (CV) includes a fluid distributing portion (control side groove portion 51C) formed at the spool (50), the fluid distributing portion (control side groove portion 51C) allowing the fluid to be supplied from the pump port (40P) to the advanced angle port (40A) irrespective of the position of the spool (50) operated to the first advanced angle position (PA1) and the second advanced angle position (PA2), the fluid distributing portion (control side groove portion 51C) allowing the fluid to be supplied from the pump port (40P) to the retarded angle port (40B) irrespective of the position of the spool (50) operated either to the first retarded angle position (PB1) and the second retarded angle position (PB2). The lock control fluid passage (53) is in communication with the fluid distributing portion (control side groove portion 51C).

According to the construction of the embodiment, the fluid from the pump port (40P) is supplied to the advanced angle port (40A) via the fluid distributing portion (control side groove portion 51C) irrespective of the position of the spool (50) operated either to the first advanced angle position (PA1) and the second advanced angle position (PA2), and the fluid from the pump port (40P) is supplied to the retarded angle port (40B) via the fluid distributing portion (control side groove portion 51*c*) irrespective of the position of the spool (50) either to the first retarded angle position (PB1) and the second retarded angle position (PB2). Further, when the spool (50) is operated to any one of the positions in which the fluid is allowed to be supplied from the pump port (40P) to the unlocking port (40L), the operation oil can be supplied to the unlocking port (40L) from (via) the lock control fluid passage (54) which is in communication with the fluid distributing portion (control side groove portion 51C) when the spool (50) is operated to any one of the positions for supplying the fluid from the pump port (40P) to the unlocking port (40L).

According to the embodiment, the control valve (CV) includes a drain fluid passage (58) formed inside the spool (50) in an attitude along the spool axis (Y), the drain fluid passage (58) draining the fluid from one of the advanced angle port (40A), the retarded angle port (40B), and the unlocking port (40L).

According to the construction of the embodiment, when draining the fluid from the advanced angle port (40A), the retarded angle port (40B), and the unlocking port (40L), the fluid can be forwarded to the drain fluid passage (58), and thus the drain port (40D) for draining the fluid can be formed at an end portion of the valve case (40).

According to the embodiment, the control valve includes a check valve (55) provided at the lock control fluid passage (54), the check valve (55) being open when the fluid is supplied to the unlocking port (40L) and being closed when a pressure of the fluid outputted via the pump port (40P) declines to be lower than a predetermined pressure level.

According to the construction of the embodiment, when supplying the fluid from the lock control fluid passage (54) to the unlocking port (40L), the check valve (55) is released to allow the supply of the fluid. Further, when the pressure level of the fluid supplied to the pump port (40P) is temporarily declined during the fluid is supplied to the unlocking port (40L), the check valve (55) is closed (is switched to be a closed state), thus maintaining the unlocked state by restraining the pressure of the fluid from declining at the unlocked port (40L).

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A control valve for selectively supplying a fluid to one of an advanced angle chamber and a retarded angle chamber formed between a driving side rotation member synchronously rotating with a crankshaft of an internal combustion engine and a driven side rotation member integrally rotating with a camshaft of the internal combustion engine, the driven side rotation member relatively rotating to the driving side rotation member, the control valve for supplying a fluid for unlocking a lock member checking a relative rotation of the driving side rotation member and the driven side rotation member, the control valve comprising:

a valve case;

a spool accommodated in the valve case;

an electromagnetic solenoid operating the spool along a spool axis extending in a longitudinal direction;

the valve case including an only one pump port to which a fluid is supplied, an advanced angle port configured to be in communication with the advanced angle chamber, a retarded angle port configured to be in communication with the retarded angle chamber, and an unlocking port configured to be in communication with the lock member;

the spool being operated to at least five positions including a first advanced angle position where the fluid is supplied to the advanced angle port and the unlocking port, a second advanced angle position where the fluid is supplied only to the advanced angle port, an unlock position where the fluid is supplied only to the unlocking port, a first retarded angle position where the fluid is supplied to the retarded angle port and the unlocking port, and a second retarded angle position where the fluid is supplied only to the retarded angle port; and a lock control fluid passage formed inside the spool in an attitude along the spool axis, the lock control fluid passage allowing the fluid from the pump port to be supplied only to the unlocking port irrespective of the position of the spool when the spool is operated to any one of the positions at which the fluid is supplied from the pump port to the unlocking port.

2. The control valve according to claim 1 further comprising:

a phase control fluid passage formed at the spool in an attitude orthogonal to the spool axis, the phase control fluid passage allowing the fluid to be supplied from the pump port to the advanced angle port irrespective of the position of the spool operated to either one of the first advanced angle position and the second advanced angle position, the phase control fluid passage allowing the fluid to be supplied from the pump port to the retarded angle port irrespective of the position of the spool operated to either one of the first retarded angle position and the second retarded angle position.

3. The control valve according to claim 2, wherein the lock control fluid passage is formed at a position diverging from the phase control fluid passage for supplying the fluid from the phase control fluid passage to the unlocking port irrespective of the position of the spool operated to any one of the first advanced angle position, the unlock position, and the first retarded angle position.

4. The control valve according to claim 1, wherein the advanced angle port, the pump port, and the retarded angle port are arranged at the valve case in the mentioned order in a direction along the spool axis and the unlocking port is arranged at a position having a predetermined distance from one of end portions of the advanced angle port and the retarded angle port, the end portions of the advanced angle port and the retarded angle port positioned being furthest each other in a direction of the spool axis; the control valve comprising:

a fluid distributing portion formed at the spool, the fluid distributing portion allowing the fluid to be supplied from the pump port to the advanced angle port irrespective of the position of the spool operated to the first advanced angle position and the second advanced angle position, the fluid distributing portion allowing the fluid to be supplied from the pump port to the retarded angle port irrespective of the position of the spool operated either to the first retarded angle position and the second retarded angle position; and wherein the lock control fluid passage is in communication with the fluid distributing portion.

5. The control valve according to claim 4 further comprising:

a drain fluid passage formed inside the spool in an attitude along the spool axis, the drain fluid passage draining the fluid from one of the advanced angle port, the retarded angle port, and the unlocking port.

6. The control valve according to claim 1 further comprising:

a check valve provided at the lock control fluid passage, the check valve being open when the fluid is supplied to the unlocking port and being closed when a pressure of the fluid outputted via the pump port declines to be lower than a predetermined pressure level.

7. A control valve for selectively supplying a fluid to one of an advanced angle chamber and a retarded angle chamber formed between a driving side rotation member synchronously rotating with a crankshaft of an internal combustion engine and a driven side rotation member integrally rotating with a camshaft of the internal combustion engine, the driven side rotation member relatively rotating to the driving side rotation member, the control valve for supplying a fluid for unlocking a lock member checking a relative rotation of the driving side rotation member and the driven side rotation member, the control valve comprising:

a valve case;

a spool accommodated in the valve case;

an electromagnetic solenoid operating the spool along a spool axis extending in a longitudinal direction;

the valve case including a single pump port to which a fluid is supplied, an advanced angle port configured to be in communication with the advanced angle chamber, a retarded angle port configured to be in communication with the retarded angle chamber, and an unlocking port configured to be in communication with the lock member;

the spool being operated to at least five positions including a first advanced angle position where the fluid is supplied from the single pump port to the advanced angle port and the unlocking port, a second advanced angle position where the fluid is supplied from the single pump port only to the advanced angle port, an unlock position where the fluid is supplied from the single pump port only to the unlocking port, a first retarded angle position where the fluid is supplied from the single pump port to the retarded angle port and the unlocking port, and a second retarded angle position where the fluid is supplied from the single pump port only to the retarded angle port; and a lock control fluid passage formed inside the spool in an attitude along the spool axis, the lock control fluid passage allowing the fluid from the single pump port to be supplied only to the unlocking port irrespective of the position of the spool when the spool is operated to any one of the positions at which the fluid is supplied from the single pump port to the unlocking port.

* * * * *